US010258897B2

(12) United States Patent
Farco

(10) Patent No.: US 10,258,897 B2
(45) Date of Patent: Apr. 16, 2019

(54) POSABLE INTERLOCKING BUILDING BLOCK CONNECTOR

(71) Applicant: Joseph Farco, Dobbs Ferry, NY (US)

(72) Inventor: Joseph Farco, Dobbs Ferry, NY (US)

(73) Assignee: Joseph Farco, Massapequa Park, NY (US)

( * ) Notice: Subject to any disclaimer, the term of this patent is extended or adjusted under 35 U.S.C. 154(b) by 218 days.

(21) Appl. No.: 15/159,804

(22) Filed: May 20, 2016

(65) Prior Publication Data

US 2016/0263490 A1 Sep. 15, 2016

Related U.S. Application Data

(63) Continuation of application No. 14/474,276, filed on Sep. 1, 2014, now Pat. No. 9,345,982.

(51) Int. Cl.

| | |
|---|---|
| ***A63H 33/08*** | (2006.01) |
| ***A63H 33/10*** | (2006.01) |
| ***A63H 33/06*** | (2006.01) |

(52) U.S. Cl.

CPC ..... *A63H 33/102* (2013.01); *A63H 33/062* (2013.01); *A63H 33/086* (2013.01); *A63H 33/10* (2013.01)

(58) Field of Classification Search

USPC ..... 446/85, 93, 97, 101, 102, 107, 108, 109, 446/116, 119, 120, 122, 123, 124

See application file for complete search history.

(56) References Cited

U.S. PATENT DOCUMENTS

| | | | |
|---|---|---|---|
| 1,113,371 | A | 10/1914 | Pajeau |
| 1,608,592 | A | 11/1926 | Funk |
| 1,707,691 | A | 4/1929 | Sweet |
| 1,843,115 | A | 2/1932 | Ferris |
| 1,898,297 | A | 2/1933 | Barcley |
| 2,019,516 | A | 11/1935 | Weinberg |
| 2,363,785 | A | 11/1944 | Gold |
| 2,542,601 | A | 2/1951 | Van Cleef |
| 2,633,662 | A | 4/1953 | Nelson |
| 2,683,329 | A | 7/1954 | Kobler |
| 2,709,318 | A | 5/1955 | Benjamin |
| 2,800,743 | A | 7/1957 | Renouf |

(Continued)

FOREIGN PATENT DOCUMENTS

| | | | |
|---|---|---|---|
| CN | 2137177 | Y | 6/1996 |
| CN | 201154223 | Y | 11/2008 |

(Continued)

OTHER PUBLICATIONS

Setti Fine Art, Creating a Figure Armature for Sculpture, (Apr. 17, 2009) (http://www.instructables.com/id/CREATING-A-FIGURE-ARMATURE-FOR-SCULPTURE/ (11 pages).

(Continued)

*Primary Examiner* — Kurt Fernstrom

(57) ABSTRACT

A toy building block system comprises a plurality of interlocking building blocks with openings to receive at least one a linkage having a head portion, a tail portion opposite the head portion, a posable metal wire connecting the head portion to the tail portion, and a cross-section of the head portion, the tail portion, the posable metal wire, or combinations thereof having a major width that is between approximately 0.123 inches and approximately 0.193 inches.

25 Claims, 15 Drawing Sheets

(56) References Cited

U.S. PATENT DOCUMENTS

| | | | |
|---|---|---|---|
| 2,854,786 | A | 10/1958 | Sabo |
| 3,176,428 | A | 4/1965 | Slingluff |
| 3,206,611 | A | 9/1965 | Onanian |
| 3,242,610 | A | 3/1966 | Chrstiansen |
| 3,286,391 | A | 11/1966 | Mengeringhausen |
| 3,346,775 | A | 10/1967 | Chrstiansen |
| 3,458,949 | A | 8/1969 | Young |
| 3,564,758 | A | 2/1971 | Willis |
| 3,605,323 | A | 9/1971 | Fischer |
| 3,624,960 | A | 12/1971 | Folson |
| 3,626,632 | A | 12/1971 | Bullock |
| 3,645,038 | A | 2/1972 | Morrison |
| 3,648,404 | A | 3/1972 | Ogsbury |
| 3,918,196 | A | 11/1975 | Schleich |
| 3,975,858 | A | 8/1976 | Much |
| 4,078,328 | A | 3/1978 | Rayment |
| 4,107,870 | A | 8/1978 | Ausnit |
| 4,182,072 | A | 1/1980 | Much |
| 4,182,076 | A | 1/1980 | Much |
| 4,193,639 | A | 3/1980 | Pauly et al. |
| 4,244,140 | A | 1/1981 | Kim |
| 4,246,718 | A | 1/1981 | Chatani |
| 4,302,900 | A | 12/1981 | Rayner |
| 4,579,538 | A | 4/1986 | Bass |
| 4,648,414 | A | 3/1987 | Fox et al. |
| 4,652,248 | A | 3/1987 | Kozuka |
| 4,666,417 | A | 5/1987 | Hillman |
| 4,758,195 | A | 7/1988 | Walsh |
| 4,758,196 | A | 7/1988 | Wang |
| 4,883,440 | A | 11/1989 | Bolli |
| D307,775 | S | 5/1990 | Pedersen |
| 4,963,115 | A | 10/1990 | Stowell et al. |
| 4,988,322 | A | 1/1991 | Knudsen |
| 5,061,219 | A | 10/1991 | Glickman |
| 5,137,486 | A | 8/1992 | Glickman |
| 5,310,376 | A | 5/1994 | Mayuzumi |
| 5,433,549 | A | 7/1995 | McGaffigan |
| 5,498,190 | A | 3/1996 | Ganson |
| 5,516,314 | A | 5/1996 | Anderson |
| 5,733,168 | A | 3/1998 | Poulsen et al. |
| 5,752,869 | A | 5/1998 | Huff |
| 5,762,531 | A | 6/1998 | Witkin |
| 5,785,529 | A | 7/1998 | Hearn |
| 5,848,503 | A | 12/1998 | Toft et al. |
| 5,916,006 | A | 6/1999 | Ganson |
| 6,000,984 | A | 12/1999 | Degner |
| 6,213,839 | B1 | 4/2001 | Pedersen |
| 6,176,756 | B1 | 6/2001 | Panec |
| 6,322,414 | B1 | 11/2001 | Lin |
| 6,454,624 | B1 | 9/2002 | Duff et al. |
| 6,461,215 | B1 | 10/2002 | Kunz et al. |
| 6,491,563 | B1 | 12/2002 | Bailey |
| 6,648,715 | B2 | 11/2003 | Wiens et al. |
| 6,676,474 | B2 | 1/2004 | Glickman |
| 6,736,691 | B1 | 5/2004 | Back |
| 6,843,700 | B2 | 1/2005 | Glickman |
| 7,332,873 | B2 | 1/2008 | Rosen et al. |
| 7,364,487 | B2 | 4/2008 | Evans et al. |
| 7,479,054 | B2 | 1/2009 | Wittenberg et al. |
| 8,371,894 | B1 | 2/2013 | Rosen et al. |
| 8,382,548 | B2 | 2/2013 | Maggiore et al. |
| 8,408,962 | B2 | 4/2013 | Sambenedetto |
| 8,460,053 | B2 | 6/2013 | Fair et al. |
| 8,708,765 | B2 | 4/2014 | Pope-Gusev |
| 8,734,198 | B1 | 5/2014 | Seldin |
| 8,753,164 | B2 | 6/2014 | Hansen et al. |
| 8,756,894 | B2 | 6/2014 | Swartz et al. |
| 8,851,953 | B2 | 10/2014 | Oschuetz et al. |
| 8,961,257 | B2 | 2/2015 | Connor |
| 9,849,398 | B2 | 12/2017 | Saigo et al. |
| 2004/0087245 | A1 | 5/2004 | Toht |
| 2005/0070199 | A1 | 3/2005 | Voves |
| 2007/0178799 | A1 | 8/2007 | Rudell |
| 2011/0177752 | A1 | 7/2011 | Patsiner |
| 2012/0214380 | A1 | 8/2012 | Vine, III |
| 2013/0109267 | A1 | 5/2013 | Schweikardt et al. |
| 2013/0244530 | A1 | 9/2013 | Renfro |
| 2013/0252503 | A1 | 9/2013 | Kwok |
| 2013/0273805 | A1 | 10/2013 | Leonhardt |
| 2014/0024283 | A1 | 1/2014 | Stolten |

FOREIGN PATENT DOCUMENTS

| | | | |
|---|---|---|---|
| EP | 0767696 | B1 | 4/1997 |
| WO | WO92/10262 | A | 6/1992 |
| WO | 9403664 | A1 | 2/1994 |
| WO | 9832509 | A1 | 7/1998 |
| WO | 03095056 | A1 | 11/2003 |
| WO | 201208200 | A1 | 6/2012 |
| WO | WO2014/005591 | | 1/2014 |
| WO | 2016036675 | A1 | 3/2016 |

OTHER PUBLICATIONS

Browning, Marie, Metal Crafting Workshop, pp. 14-15 (Sterling Publishing Co., Inc., NY 2006) (5 pages).
http://www.instructables.com/id/How-to-make-LEGO-bendy/ (4 pages).
Jun. 5, 2017 Non-final Office Action re: U.S. Appl. No. 15/251,953 (13 pages).
http://www.eurobricks.com/forum/index.php?showtopic=48318 (Nov. 2010).
Fernando Correia, "TBs TechPoll 24—Should the Flex System return?" http://www.technicbricks.com/2011/03/tbs-techpoll-24-should-flex-system.html, Mar. 8, 2011, pp. 1-3.
Lego® Technic Set 5118 (1991).
Lego® Technic Set 7471 (2000), cover, 68-69 et seq.
Lego® Technic Set 8002 (2000), cover, 54-56, 59-62, 64, 69-70, 76-77, 83-98 et seq.
Lego® Technic Set 8074 (1991), cover, 1, 11-13 et seq.
Lego® Technic Set 8412 (1995), cover, 8-11, 14-18, 23-25, 27-35.
Lego® Technic Set 8437 (1997), cover, 24-31, 41, 43-45, 49-50, 52-60.
Lego® Technic Set 8440 (1995), cover, 4-7, 10-12, 28, 31-33, 35-36, 38-41.
Lego® Technic Set 8444 (1999), cover, 2, 6-21, 24-37, 39-42, 45, 47, 49-53, 55, 57-59, 62-63.
Lego® Technic Set 8445 (1999), 31, 41, 44-50, 52-56, 59, 62-63, 69-71, 80-87, 92-94, 114.
Lego® Technic Set 8457 (2000), 33, 37-43, 155-162.
Lego® Technic Set 8479 (1997), 49-50, 55-56, 77.
Lego® Technic Set 8482 (1998), https://www.youtube.com/watch?v=744g0USfW2w.
Lego® Technic Set 8483 (1998), https://www.youtube.com/watch?v=744g0USfW2w.
Lego® Technic Set 8485 (1995), [first model] at 23-24, [third model] at 19-30, 32-37, 42, 47.
Lego® Technic Set 8828 (1992), 9.
Lego® Technic Set 8836 (1992), 8.
Lego® Technic Set 8839 (1992), 4, 8-13, 23.
Lego® Technic Set 8856 (1991), 4, 10-19, 23, 39-40.
Lego® Technic Set 9748 (1999), 22, 36, 51, 53-55, 60-61, 63-64, 69-70, 72-74, 76-77, 80-82, 109-114.
Lego® Technic Set 8272 (2007), 63-64, 67-69.
Lego® Technic Set 5218 (2000), cover, 4-5, 16-23, 33-34, 43, 52, 54-66, 68, 73, 80-81, 95-99, 103-104.
http://www.eurobricks.com/forum/index.php?showtopic=79234.
Rodriguez, Luis, "FlexRoads." (Copyright 2010).
Micro Light Board Usage Guide, http://brickstuff.dozuki.com/Guide/Micro+Light+Board+Kit+Usage+Guide/5, 2012.
240 Lego System Idea Book, 3170-a, Lego AS Europe, 19 (Aller GmbH, Ultzberg, Germany, 1967), pp. 12-13, 32-47, 50-51, cover-backpage.
1965 Lego Planpacks and Packs Catalog, pp. 1-4.
1967 Lego® Catalog, pp. 4-5.
1969 Lego® Catalog, excerpts.
Lego® Building Toy, Motor Pak, "Lego Now has Gears and Motor."
1969 Lego® System catalog, excerpts.

(56) References Cited

OTHER PUBLICATIONS

Lego® Model Maker 107 (1968), "Battery-Operated Reversible Power Unit."
Lego—Motor—Eisenbahn (undated).
Lego verwirklict den Baugeclanken fur Spielzeugautos (1967).
Lego® Set 115, cover page.
Lego® Set 116 (1968), cover, pp. 1-4.
Lego® Set 118 (1969), cover, p. 11.
Lego® Set 119 (1968), cover, pp. 1-3, 6.
Lego® Set 119-157 (1968), cover, pp. 1-2.
Lego® Set 120 (1969), cover, pp. 4-7.
Lego® Set 122 (1969), cover, p. 4.
Lego® Set 133 (1975), cover, pp. 4-5.
Lego® Set 138, (1969), cover, pp. 8-11.
Lego® Set 161 (1972), cover, p. 2.
Lego® Set 162 (1977), cover, pp. 3, 6, 11.
Lego® Set 180 (1972), cover, p. 5.
Lego® Set 182 (1975), cover, back page, pp. 1-4.
Lego® Set 183 (1976), cover, pp. 2-6.
Lego® Set 210 (1976), cover, pp. 1-3.
Lego® Set 404 (1977), cover, pp. 1, 4-5, 7-8, 14-15.
Lego® Set Electronic 118 (1969), cover, back page, pp. 1-9.
LiteBrix® Set 35707 (2013), pp. 22, 26-33.
LiteBrix® Set 35703 (2013), pp. 2, 8-13, 57, 59-61.
LiteBrix® Set 35700 (2013), pp. 3-4, 6-7, 9-20, 22-24.
LiteBrix® Set 35800 (2012), pp. 2, 11-15.
LiteBrix® Set 35810 (2013), pp. 2, 40-42.
U.S. Appl. No. 13/365,907, filed Sep. 27, 2012 Amendment and Respons to Aug. 31, 2012 Office Action, Remarks, pp. 13-21.
E. Pannestri, M. Cavacece, L. Vita, On the Computation of Degrees-of-Freedom: A Didactic Perspective, DETC2005-84109, Proceedings of IDETC '05, 2005 ASME International Design Engineering Technical Conferences and Computers and Information Engineering Conference, Long Beach, CA, USA, Sep. 24-28, 2005.
Kre-O® Set 38771 (2011), pp. 20-36, 56-75, 78.
Berard, Jamie, Stressing the Elements, Aug. 2006, Lego.
Bendables™—The Bendable Construction System.
Bendits™—product boxes photographs.
Lego® Master Builder Academy Designer Handbook 20200—Kit/Level 1—Space Designer 4646874 (2011), pp. 17, 35.
http://www.mocpages.com/moc.php/265752 (Apr. 26, 2011).
http://www.halfbakery.com/idea/Flegos (Jun. 21, 2006).
http://shop.lego.com/en-US/Doc-Ock-Truck-Heist-76015?p=76015 (Mar. 6, 2014).
http://www.instructables.com/id/Lego-polymer-clay-figure/?ALLSTEPS.
United States Consumer Product Safety Commission, "Laboratory Test Manual for Toy Testing—Requirements for Testing of Toys and Other Articles Intended for Use by Children 12 Years and Under," Jun. 2010, CPSC, 91 pages.
/www.genuinemodels.com/demag_crane.htm, Feb. 11, 2003 based on https://web.archive.org/., 26 pages. See p. 13.
International Search Report in PCT/US2015/047836 (published as WO2016/036675 A1), dated Jan. 11, 2016, 4 pages.
Written Opinion in PCT/US2015/047836 (published as WO2016/036675 A1), dated Jan. 11, 2016, 6 pages.
Barry Dupen, Applied Strength of Materials for Engineering Technology, (2012), 128 pages.
Oct. 4, 2016 International Preliminary Examination Report on Patentability in PCT/US15/47836, 24 pages.
Oct. 28, 2016 Decision on Petition in PCT/US15/47836, 3 pages.
Jan. 11, 2018 Final Office Action in U.S. Appl. No. 15/251,953 (16 pages).
Jun. 8, 2018 Non-Final Office Action in U.S. Appl. No. 15/251,953 (22 pages).
Dec. 12, 2018 Final Office Action in U.S. Appl. No. 15/251,953 (20 pages).
Jan. 30, 2019 Notification of First Office Action, Chinese Patent Application No. 201580058755X, 4 pages.

FIG. 7A
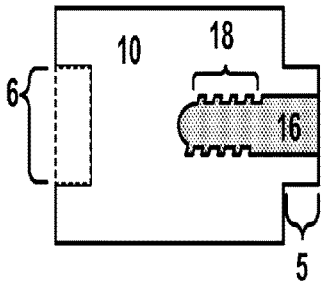
FIG. 7B
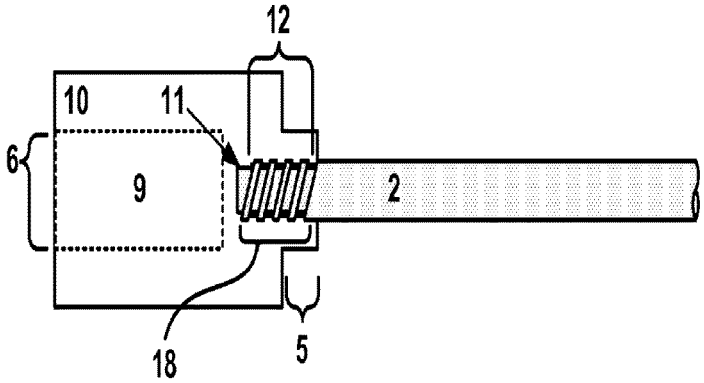
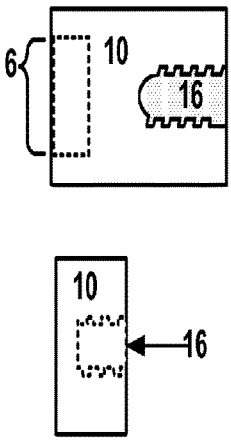
FIG. 7C
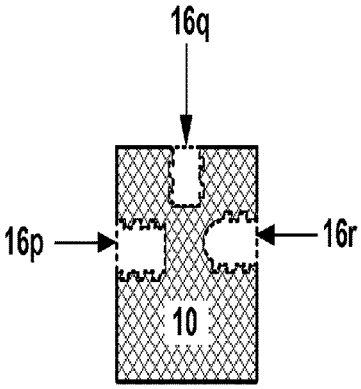
FIG. 7D
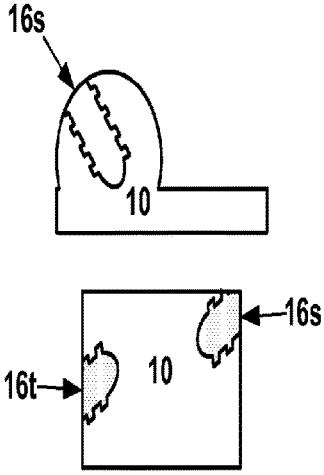
FIG. 7E

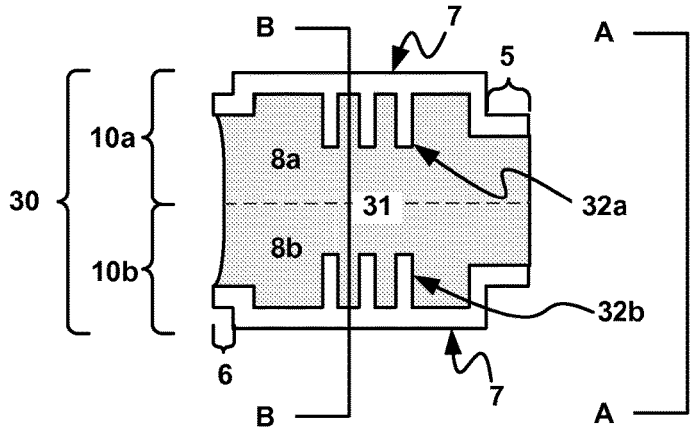
FIG. 8
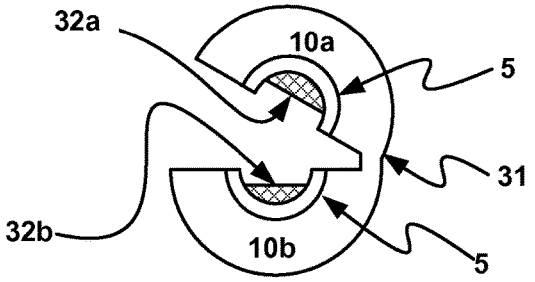
FIG. 8A
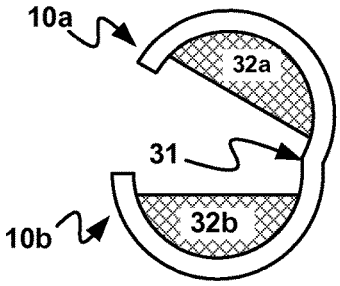
FIG. 8B
FIG. 9A
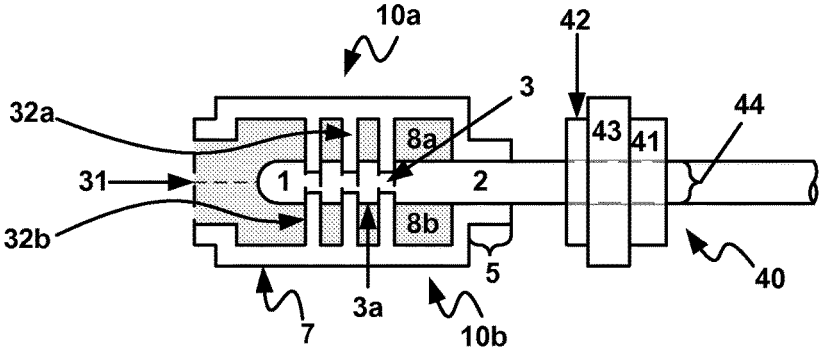
FIG. 9B
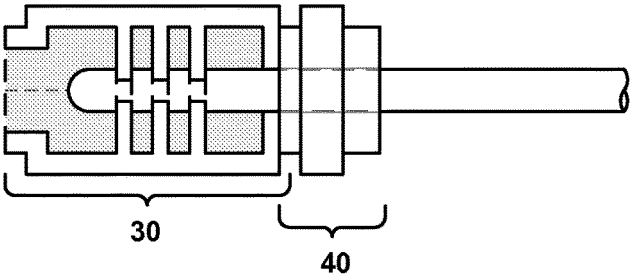

POSABLE INTERLOCKING BUILDING BLOCK CONNECTOR

RELATED APPLICATIONS

This application is a continuation of U.S. patent application Ser. No. 14/474,276, filed on Sep. 1, 2014, the disclosures of which are incorporated herein by reference in their entirety.

FIELD OF THE INVENTION

Disclosed are embodiments of the invention that relate to, among other things, building block linkage and joint systems and methods.

BACKGROUND

Linkages for toy building blocks, such as those made by LEGO®, Duplo®, Mega Bloks, Built to Rule, K'nex, Kre-O, and others, provide limited degrees of movement and positioning in the three dimensional plane for the blocks they connect.

Flexible plastic cables, string, plastic rods, and plastic tubes have been used to connect building blocks, as illustrated and described in U.S. Pat. Nos. 5,433,549, 5,733,168, 6,000,984, 6,213,839, 6,461,215, 6,676,474, 6,843,700, and PCT/DK1991/000373. Other prior art systems are Lego® Technic Sets 5118, 7471, 8002, 8074, 8412, 8437, 8440, 8444, 8445, 8457, 8479, 8482, 8483, 8485, 8828, 8836, 8839, 8856, and 9748.

As shown in FIG. 1A, an end P1 is connected to a bendable plastic rod P2 via neck P3. Front end P1, rod P2, and neck P3 are shaped to be received in a complementary slot P11-P13 of the receiver block P10. Thus, a plastic rod P2 with necks P3 and ends P1 disposed on either terminus of the rod P2 is used to tether blocks to which receiver block P10 may couple, provided the necks P3 and ends P1 are capable of receipt in the receiver block slots P11-P13. In an alternative arrangement shown by FIG. 1B, a receiver block P10 is comprised of a jaw P5, a mouth P6, and a tooth P7 that engages a recess/neck P3 in a plastic rod P2 received within block P10. In this arrangement, the prior art receiver block P10 relies on plastic-on-plastic coupling between tooth P7 and recess P3 to maintain rod P2 in the block P10, e.g., a crimping connection.

All of these linkage systems suffer disadvantages in terms of the reduction in strength from repeated use and/or exposure to heat, weakness when loaded in a direction perpendicular to their cross-section, and/or lack of ability to be bent in any number of conformations while also substantially maintaining a conformation in three-dimensional space, e.g., wilting or buckling in response to loads.

SUMMARY OF THE INVENTION

A system and method of assembling building blocks involves a posable metal linkage comprising a plurality of ends and a building block, such as a Lego-like brick, having means for coupling at least one of the plurality of ends of the posable metal linkage within a cavity located therein.

By having posability, a linkage may have an unlimited range of displacement in three-dimensional space and be able to hold its conformation in loaded and/or unloaded configurations. Such a linkage may serve as a universal joint for building blocks.

The posable linkage may be coupled to a building block using one or more of the following: the building block apertures themselves, a combination of the building block apertures and intermediary components within the building block, and/or a socket or adaptor disposed within the building block either alone or in combination with other features of the building block.

BRIEF DESCRIPTION OF THE DRAWINGS

FIGS. 5, 6A-B, and 7A-F illustrate other exemplary embodiments of other forms of exemplary inventive building block linkage systems and assembly methods.

FIGS. 8 and 8A-B illustrate views of an exemplary anchor block for various forms of exemplary inventive building block linkage systems and assembly methods.

FIGS. 9A and 9B illustrate still another exemplary embodiment of other forms of exemplary inventive building block linkage systems and assembly methods.

Figure 1A:
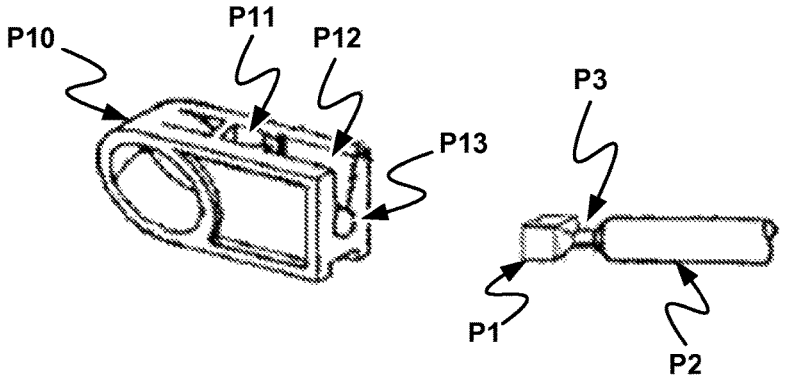
FIGURE 1A (PRIOR ART)
FIGS. 1A-1B illustrate the prior art and have been previously described.
Figure 1B:
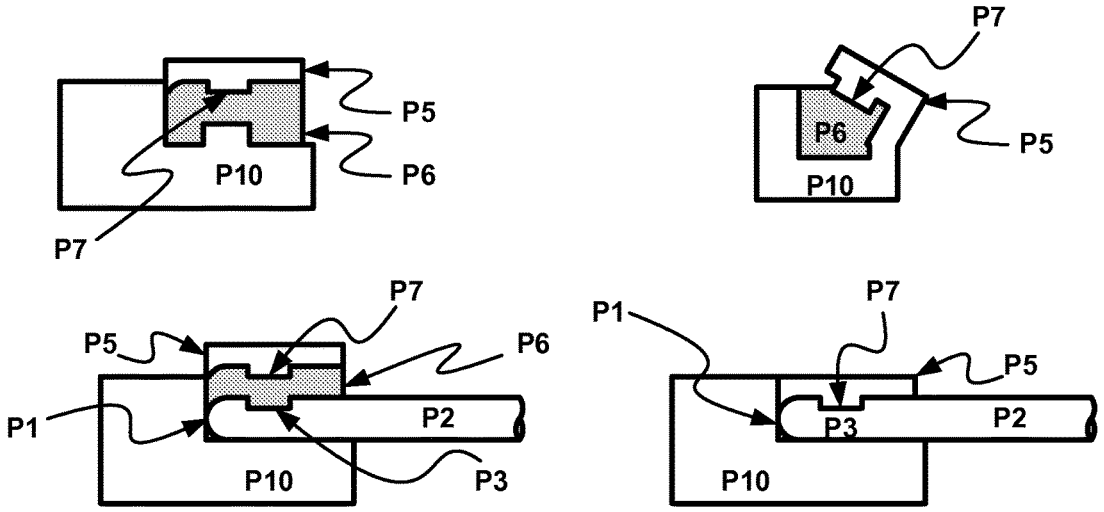
FIGURE 1B (PRIOR ART)

In the drawings like characters of reference indicate corresponding parts in the different figures. The drawing figures, elements and other depictions should be understood as being interchangeable and may be combined in any like manner in accordance with the disclosures and objectives recited herein.

DETAILED DESCRIPTION

Figure 2:
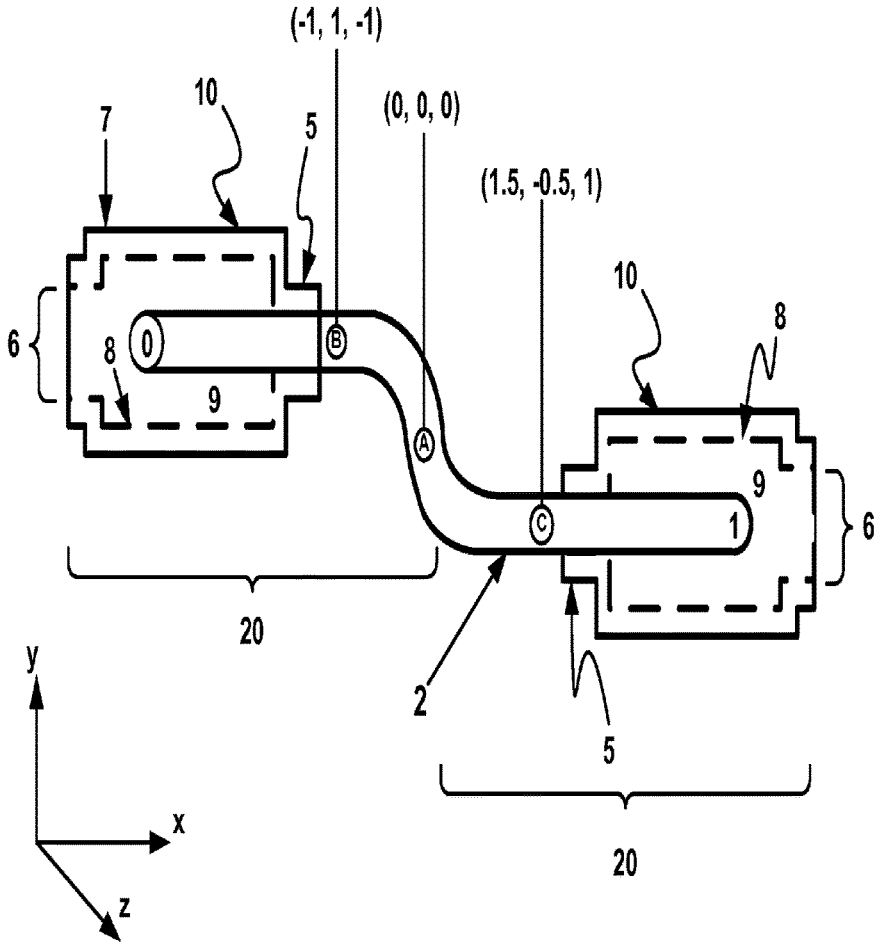
FIG. 2 illustrates an exemplary embodiment of one form of exemplary inventive building block linkage system.

With respect to FIG. 2, an exemplary linkage 2 may be configured to fit within an opening 5 of a receiving exemplary building block 10 (hereinafter referred to as block or brick 10, which may be a Lego-like brick). An exemplary brick 10 may be made of plastic, rubber, or metal, but preferably PLA plastic. An exemplary brick 10 may be prismatic, cubic, spherical, conical, pyramidal, or any other form of polyhedron in shape. When assembled, the head 1 and tail 0 of an exemplary linkage 2 may be located within a cavity 9 of exemplary block 10. In a preferred embodiment, head 1 of an exemplary linkage 2 need not enter the exit 6 of exemplary block 10. The opening 5 and exit 6 of an exemplary block 10 may also serve as adaptors for connecting exemplary block 10 to other building blocks. For example, in an exemplary Lego® block 10, opening 5 may be sized to fit within the exit 6 of another exemplary building block (not shown). Conversely, an exit 6 of an exemplary Lego® block 10 may be sized to fit about an opening 5 of another exemplary building block. According to these embodiments, the engagement between an exemplary linkage 2 and exemplary block 10 may be considered a joint 20.

In one embodiment, an exemplary linkage 2 is made of a metal and is flexible yet posable. An example of posability may be that an exemplary linkage 2 can be bent into any conformation, without any limit on degrees of freedom of movement and substantially maintain that conformation in three-dimensional space. As another example of posability, an exemplary linkage 2 may be configured to dispose at least two blocks 10, which are adapted to receive an exemplary linkage 2, in different positions in three-dimensional space and substantially maintain those positions over time without the need for any other movable parts but the linkage 2. Accordingly, an exemplary linkage 2 may be the exclusive means of positioning exemplary building blocks which it interconnects. As such, an exemplary linkage 2 may allow exemplary building blocks to be translated, rotated, and/or held in positions with respect to one another in three-dimensional space.

In another embodiment, an exemplary linkage 2 may have one or more of the following exemplary characteristics: (i) a wire-like shape; (ii) made out of one or more of the following and/or their combinations and/or galvanized variants: aluminum, copper, iron, or brass; (iii) dimensioned so that it can be received within an opening 5 and/or an exit 6 of an exemplary block 10; (iv) dimensioned so that it can be received within fabric, flexible plastic, or elastomer tubing; (v) dimensioned so that its diameter is within the range of diameters between those of opening 5 and those of exit 6 of an exemplary block 10; (vi) a diameter of approximately 0.123 inches to approximately 0.193 inches; (vii) be approximately 5- to approximately 8-gauge wire; or (viii) be an armature wire. In a most preferred embodiment, an exemplary linkage 2 is about 0.12574 inches in diameter and is made from a flexible aluminum armature wire. While an exemplary linkage 2 may preferably be circular in cross-section, any number of cross-sections of an exemplary linkage 2 may be contemplated depending on the exemplary brick with which it couples.

For example, an exemplary linkage 2 may be configured so that it and/or its head 1 or tail 0 may friction-fit within an exemplary block 10 opening 5, exit 6, and/or other such aperture as described herein, provided the exemplary block 10 material creating the cross-section of such opening 5, exit 6, and/or other such aperture does not go beyond its modulus of resilience (e.g., the cross-section may be the same as or smaller than the cross-section of an exemplary linkage 2, head 1, and/or tail 0). Where multiple cross-sections are involved, an average cross-section may be used to determine the applicable modulus of resilience. An average cross-section of an exemplary linkage 2 may be the cross-section at one end of linkage 2 to the point on linkage 2 just before where the cross-section remains substantially un-changed along the length of linkage 2. An average cross-section may be utilized for determining the average cross-section of an aperture in exemplary block 10, e.g., measuring the cross-section from the opening 5 or exit 6, whichever is closest to the cross-section of the aperture surface most distal to the beginning measuring point whether it be opening 5 or exit 6 as the case may be.

An exemplary linkage 2 may be included in and made out of any other material or combination of materials that results in properties equivalent to those achieved by structures with one or more of the foregoing characteristics and posabilities. For example, a metal wire may be included within an elastomer tube so that the combination of the two, which together form an exemplary linkage 2, may have the flexibility and posability of the underlying metal wire. Those skilled in the material arts may be able to identify other materials of which a single exemplary linkage 2 can be made to achieve one or more of the foregoing requirements of the metal linkage 2 embodiments, such as, polymers and plastics, provided the final composition has posability.

An exemplary linkage 2 may have a plurality of orientations in three-dimensional space in which it may position blocks coupled thereto. In the illustrative embodiment of FIG. 2, any number of different points in three-dimensional space, identified by Cartesian coordinates (x, y, z), may be found about the length of a single exemplary linkage 2. For example, point "A" on an exemplary linkage 2 has exemplary coordinates (0, 0, 0), meaning that this portion of exemplary linkage 2 may serve as an origin position or point of comparison. Point "B", which has coordinates (−1, 1, −1), may suggest that this part of linkage 2 is located in a plane behind and above Point "A" in three-dimensional space. Point "C", which has coordinates (1.5, −0.5, 1), may suggest that this part of an exemplary linkage 2 is in a plane ahead of and under point "A." Thus, each of the blocks coupled to exemplary linkage 2 as shown in FIG. 2 are oriented and positioned in different parts of three-dimensional space. Further, an exemplary linkage 2 may be configured so that the positioning of the blocks coupled thereto in the three-dimensional space is substantially maintained. Because of its flexibility, an exemplary linkage 2 may also be configured so that its parts have different positions in three-dimensional space as bricks are displaced from one position to another. Further orientation arrangements capable with an exemplary linkage 2 may also be understood with reference to FIGS. 11C and 15, and their related disclosures.

With reference to FIGS. 3A-D, exemplary linkages 2 may be shown with different heads 1. For ease of reference, head 1 may be considered the portion of an exemplary linkage 2 that may be used to join an exemplary linkage 2 to exemplary bricks 10, although tail 0 may have the same or similar purpose for the same or different bricks 10. Thus, head 1 has no restrictive beginning point, but may comprise one end of an exemplary linkage 2. Likewise, tail 0 has no restrictive beginning point, but may comprise the other end of an exemplary linkage 2 opposite head 1. In an exemplary linkage 2 of the wire-type, such linkage may have a head 1 and a tail 0 at either end. While an exemplary linkage 2 has thus far been described in such manner, the inventive system may utilize linkages 2 made up of multiple heads 1/tails 0 depending on design purposes, e.g., linkages with "Y" shapes, "X" shapes, cruciform, and others. Unless otherwise indicated, embodiments showing only one head 1 or tail 0 of an exemplary linkage 2 do not foreclose the existence of any number of heads 1, tails 0, and linkage 2 types previously described. Additionally, while a head 1 or tail 0 may be used to illustrate an embodiment and describe it, it should be understood that descriptions of one may apply equally to the other.

Figure 3A:
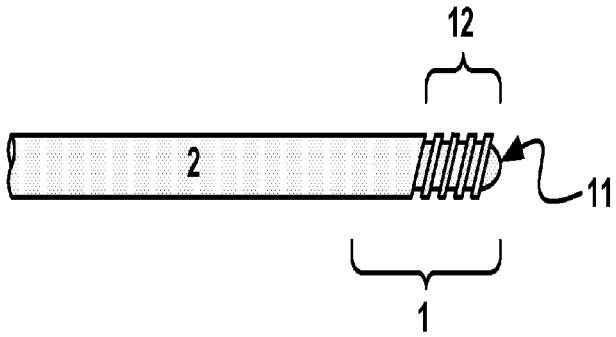
FIGS. 3A-D illustrate exemplary embodiments of exemplary building block linkages for an exemplary inventive building block linkage system and assembly method.
Figure 3B:
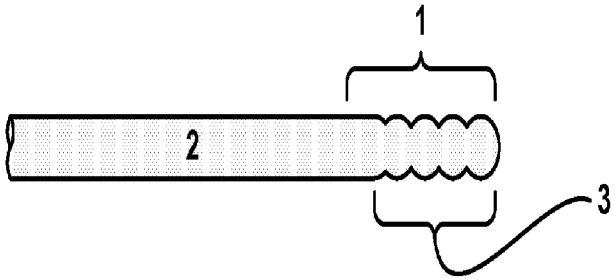
Figure 3C:
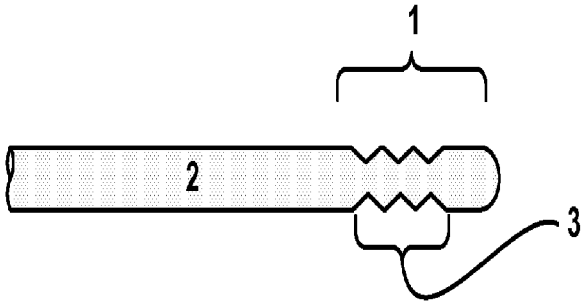
Figure 3D:
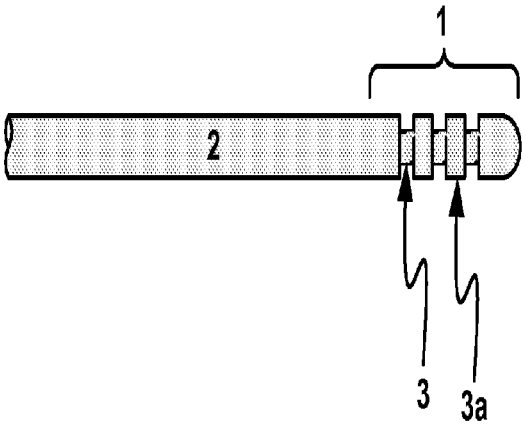

An exemplary linkage 2 may be shown in FIG. 3A as having a head 1 comprised of a conical or spherical terminus 11 and one or more threads or windings 12. While shaped in this fashion, terminus 11 may be flat, concave, or any other surface. In another exemplary embodiment illustrated by FIGS. 3B and 3C, an exemplary linkage 2 may have a head 1 comprised of bumps or curved recesses 3 about the linkage's circumference and/or perimeter. In yet another exemplary embodiment, which may be illustrated by FIG. 3D, an exemplary linkage 2 may have a head 1 comprised of one or more discs 3*a* separated by one or more recesses 3. The head 1 of an exemplary linkage 2 may comprise one or more of the aforementioned and other surface features for the purposes of serving as part of an exemplary system described herein. Such contours may be made by 3D printing, laser machining, laser sintering, CNC machining, lathes, molding, extrusions, taps, and/or dies.

Figures 4A, 4B, 4C, 4D:
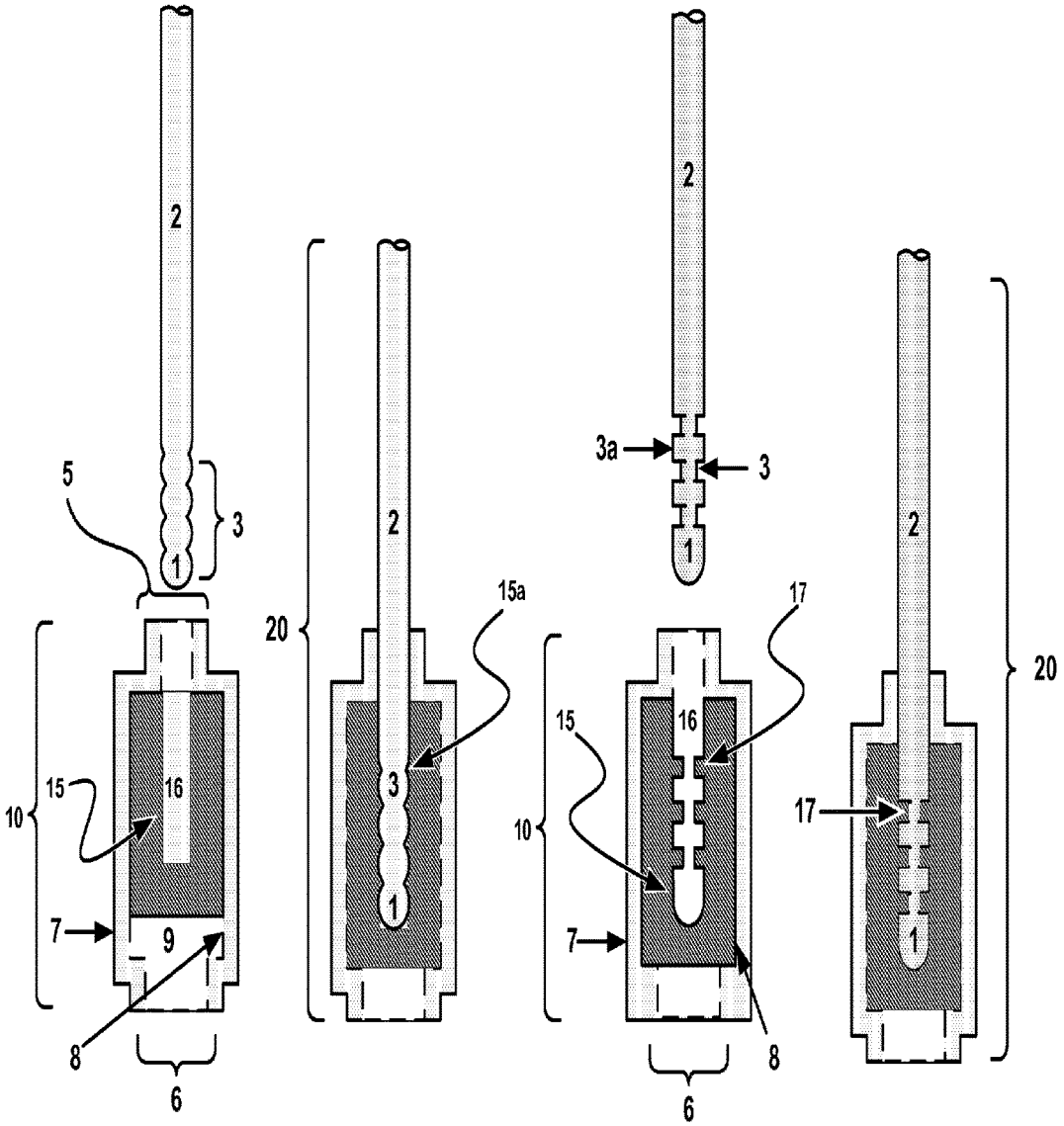
FIGS. 4A-G illustrate other exemplary embodiments of other forms of exemplary inventive building block linkage systems and assembly methods.

The illustrative embodiment of FIG. 4A may show parts of an exemplary inventive system. According to this illustrative embodiment, an exemplary linkage 2 may have a head 1 comprised of round surfaces 3. An exemplary linkage 2 in FIG. 4A may be received within exemplary brick 10 through opening 5. In this illustrative embodiment, exemplary brick 10 may be hollow inside so that it may have a cavity 9 with inner surface 8 and an outer surface 7. Disposed within cavity 9 of exemplary brick 10 may be an exemplary socket 15.

According to one aspect of an inventive system, an exemplary socket 15 may be sized, shaped, and/or contoured to fit partially or completely within cavity 9, e.g., as a prismatic, spherical, or other polyhedron shape, in order to receive and hold a head 1 or tail 0 of an exemplary linkage 2. For example, an exemplary socket 15 may be such that it does not inhibit the use of opening 5 or exit 6 to allow exemplary brick 10 to combine with other building blocks. Alternatively, an exemplary socket 15 may be contoured so that when placed within an exemplary brick 10, it may have recesses sized and shaped like an exemplary opening 5 or exit 6 to allow exemplary brick 10 to combine with other bricks. In a preferred embodiment, an exemplary socket 15 may be a component of an exemplary inventive system that may be placed within exemplary brick 10 so as not to disturb its uses and functions for assembly with other building blocks.

As shown in FIG. 4A, an exemplary socket 15 may comprise a channel 16 into which an exemplary linkage 2 may be received. Channel 16 may be sized and shaped to complement head 1 of linkage 2 when received within an exemplary socket 15. Alternatively, channel 16 may be sized and shaped so that head 1 of linkage 2 friction-fits within an exemplary socket 15. For example, as shown in FIG. 4B, an exemplary inventive system 20 may have a linkage 2 with a head 1 comprised of a plurality of spherical surfaces 3. When inserted into exemplary brick 10 containing an exemplary socket 15, spherical surfaces 3 compress walls of cylindrical channel 16 while walls of channel 16 press against spherical surfaces 3. In this manner, channel 16 may be molded so that compression surfaces 15*a* hold or brace the head 1 of linkage 2 so as to maintain its reception in an exemplary socket 15 and thereby retention in exemplary brick 10. According to another exemplary embodiment, channel 16 may be sized and shaped for bracing an exemplary linkage 2 but allow passage of other exemplary building blocks known to those skilled in the art, e.g., as may be illustrated in FIGS. 5 and 14D.

In an exemplary embodiment, channel 16 may possess an average cross-section (as measured from its furthest depth to its terminus at the surface of an exemplary socket 15) that is greater than 0% and up to about 15% smaller than the average cross-section of head 1 or tail 0 of an exemplary linkage 2 (as measured from the end of linkage 2 to the terminus of the contours on either head 1 or tail 0). In an exemplary embodiment, channel 16 may be about 13% smaller in average cross-section compared to that of head 1 or tail 0 of linkage 2. Alternatively, a cross-section or average cross-section of channel 16 may be up to any percentage smaller than a cross-section or average cross-section of head 1 or tail 0 of linkage 2 so long as the introduction of such head 1 or tail 0 of linkage 2 does not cause an exemplary socket 15 to go beyond its modulus of resilience at a given temperature and hardness.

With reference to the illustrative embodiment of FIG. 4C, another exemplary socket 15 within exemplary brick 10 may have a contoured channel 16 having one or more grips 17 for gripping or bracing an exemplary linkage 2, which may have a head 1 comprising disks 3*a* and recesses 3. As previously described with respect to channel 16, an exemplary contoured channel 16 may have the same characteristics, such as being complementary to the shape of head 1 or be slightly smaller to create a friction-fit by way of compression surfaces 15*a*. In another exemplary embodiment, channel 16 may not be complementary to linkage 2 and/or head 1 so as to create more gripping, hugging, and/or bracing surfaces within channel 16.

As illustrated in the exemplary embodiment depicted in FIG. 4D, an exemplary joint 20 may comprise an exemplary linkage 2 with a head 1 comprised of alternating discs 3*a* separated by recesses 3 braced by grips 17 in an exemplary socket 15. According to this exemplary embodiment, complimentary grips 17 and recesses 3 may result in a robust connection between linkage 2 and exemplary brick 10. For example, where an exemplary socket 15 may be made of an elastomer material, a linkage 2 with a head 1 comprising alternating discs 3*a* and recesses 3 may be pushed against the grips 17 of an exemplary socket 15 causing them to deflect distally from the direction of entry of the linkage 2. According to such an embodiment, an exemplary elastomer socket 15 with elastic grips 17 may allow the grips 17 to deflect back towards the direction of entry of linkage 2 after a linkage 2 contour passes such that they are substantially found between the linkage 2 contour (as illustrated, discs 3*a*) and adjacent to the recesses 3 of the head 1. With respect to this embodiment, the elasticity of grips 17 may allow them to permit entry of head 1 of linkage 2 when inserted into the socket 15 while substantially resisting departure of head 1 from an exemplary socket 15 if linkage 2 experiences forces tending to displace it from an exemplary socket 15, e.g., tension forces.

Figure 4E:
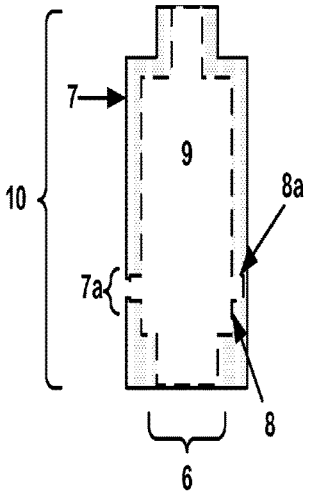
Figure 4F:
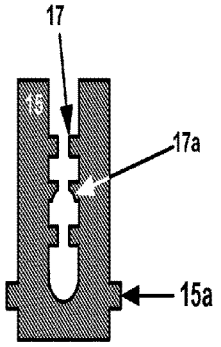
Figure 4G:
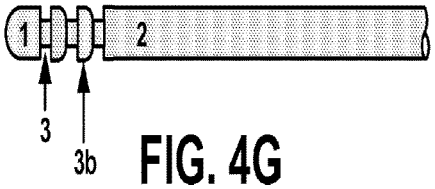

In an alternative embodiment illustrated with respect to FIGS. 4F and 4G, grips 17 may be modified to allow easier displacement from an exemplary socket 15 (e.g., sloped grips 17*a*) and/or discs 3*a* may be modified to allow head 1 of an exemplary linkage 2 to more easily displace from gripping socket (e.g., bowl discs 3*b*).

In another exemplary embodiment illustrated by FIG. 4E, an exemplary brick 10 may have a crevice 8*a* in inner surface 8. An exemplary crevice 8*a* may be of any cross-section and may span partially or fully about inner surface 8, including about the circumference of inner surface 8, in an intermittent arrangement about inner surface 8, and/or in a continuous/discontinuous spiral pattern. Preferably, crevice 8*a* may be located between opening 5 and exit 6 of exemplary brick 10. Preferably, crevice 8*a* may be only within cavity 9. Alternatively, an exemplary crevice 8*a* may be a through-hole 7*a* connecting inner surface 8 to outer surface 7. As will be further described, a through-hole crevice 8*a* may be useful for selective operation of system 20.

Further illustrated in the illustrative embodiment of FIG. 4F may be an exemplary socket 15 having wings 15*a*. Exemplary wings 15*a* may be configured to be received within an exemplary crevice 8*a* within exemplary brick 10. While wings 15*a* may be shown as single extensions from the circumference of a circular socket 15, they may also be shaped to spiral about the outer surface of an exemplary socket 15 so that when met with complementary spiral crevice 8*a*, such a socket 15 may be screwed into exemplary brick 10. Accordingly, an exemplary interaction between crevice 8*a* and wings 15*a* may further increase the bracing capability of an exemplary socket 15 in an exemplary joint 20.

As previously described with respect to a through-hole crevice 8*a*, reception of an exemplary socket 15 within an exemplary brick 10 with such a through-hole 7*a*, such as may be illustrated with respect to FIG. 4E, may possess the added advantage of being released from exemplary brick 10 by inserting a pin or pencil point into through-hole 7*a* to depress wing 15 located in the through-hole crevice 8*a*. In so doing, an exemplary socket 15 may be released from cavity 9. Crevice 8*a* and wings 15*a* may be complementarily shaped and/or sized to increase friction there between, e.g., crevice 8*a* may be triangular in cross-section while wings 15*a* were circular or rectangular. Preferably, an exemplary brick 10 possesses one crevice 8*a* that is substantially spherical in shape while an exemplary socket 15 may have one wing 15*a* that is substantially spherical in shape. Other varieties and combinations may be configured for particular needs.

Figure 4H:
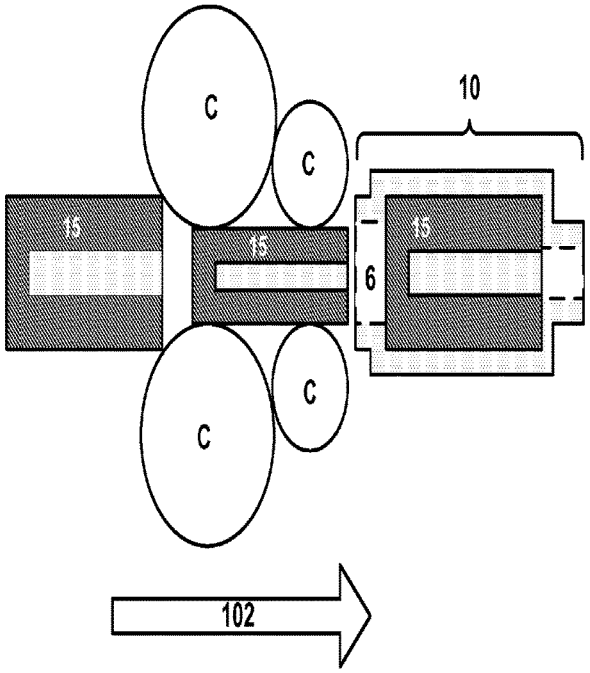
FIG. 4H illustrates an exemplary socket loading technique for exemplary inventive building block linkage systems.

As illustrated in FIGS. 4A-G, an illustrative inventive system 20 may be such to reduce the propensity of an exemplary linkage 2 from disengaging from exemplary brick 10 by way of an exemplary socket 15. An exemplary socket 15 may be made of polymer, and more particularly, an elastomer material or thermoplastic, preferably an elastomer such as rubber or silicone. As an elastomer, an exemplary socket 15 may be advantageously suited for insertion in exemplary brick 10 by way of a calendaring process 102 shown in FIG. 4H. While other forms of calendaring processes may be understood to those skilled in the art, the exemplary calendaring process illustrated diagrammatically in FIG. 4H may show calendaring wheels C compressing elastomer socket 15 so as to fit within exit 6 of an exemplary brick 10.

Figure 5:
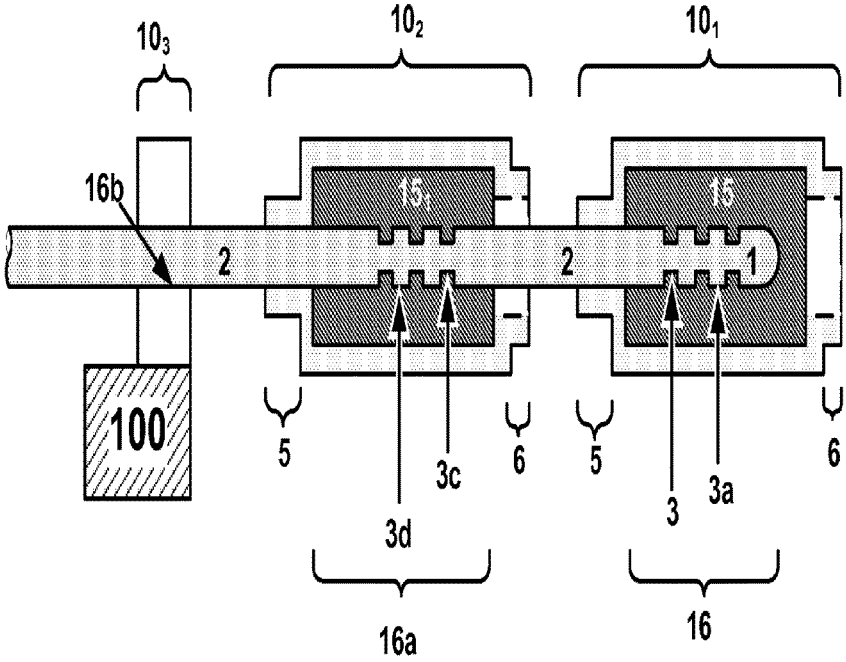

With reference to the illustrative embodiment of FIG. 5, an exemplary linkage 2 may be comprised of a head 1 for reception within a channel 16 as well as intermediary ribs 3*c*/3*d* extending from its own surface structures, which may be the same as or different from those on head 1 and proximal or distal to the same, for reception in a separate channel 16*a* of a separate socket 15 in a separate exemplary brick 10. For example, an exemplary linkage 2 may have a head 1 comprising recesses 3 and fins 3*a*. The same exemplary linkage 2 according to this illustrative embodiment may have grooves 3*c* with extensions 3*d*. A first exemplary brick $\mathbf{10}_1$ may be coupled to head 1 of an exemplary linkage 2 by way of an exemplary socket 15 such that linkage 2 does not pass from exemplary brick $\mathbf{10}_1$ opening 5 to exit 6 via channel 16. Grooves 3*c* and extensions 3*d* may also friction fit a second exemplary brick $\mathbf{10}_2$ by way of a second through-socket $\mathbf{15}_1$ whose through channel 16*a* allows full passage of an exemplary linkage 2 from opening 5 to exit 6 of the exemplary brick $\mathbf{10}_2$. Alternatively, one or more exemplary bricks $\mathbf{10}_3$ may comprise channels 16*b* that slidingly or frictionally engage the non-contoured surface of an exemplary linkage 2. Alternatively, exemplary bricks $\mathbf{10}_3$ may also slidingly or frictionally engage both contoured and non-contoured surfaces of an exemplary linkage 2. While exemplary brick $\mathbf{10}_3$ may be illustrated as a small exemplary brick, e.g., a 1×1 Lego® plate, exemplary brick $\mathbf{10}_3$ may be any size and shape with a channel 16*b* through its surfaces.

An exemplary multi-surface linkage 2 may be able to interact with numerous exemplary bricks $\mathbf{10}_n$ (where n is any integer) to provide building points for other exemplary blocks, e.g., exemplary building blocks 100, on its posable surface. In other words, exemplary bricks $\mathbf{10}_2$ may be anchored by surface structures intermediary of linkage 2's head 1 and tail 0, e.g., exemplary block $\mathbf{10}_3$. While such exemplary bricks have been shown having a through socket $\mathbf{15}_1$ other forms of exemplary bricks $\mathbf{10}_2$ and $\mathbf{10}_3$, with and without an exemplary socket 15 that permit full passage of an exemplary linkage 2 there through, are also suitable. Thus, an exemplary linkage 2 may act as the foundation for building numerous block structures on its flexible surfaces and may serve as a universal scaffolding for exemplary building block assemblies 100.

Figure 6A:
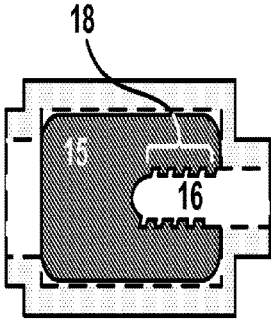
Figure 6B:
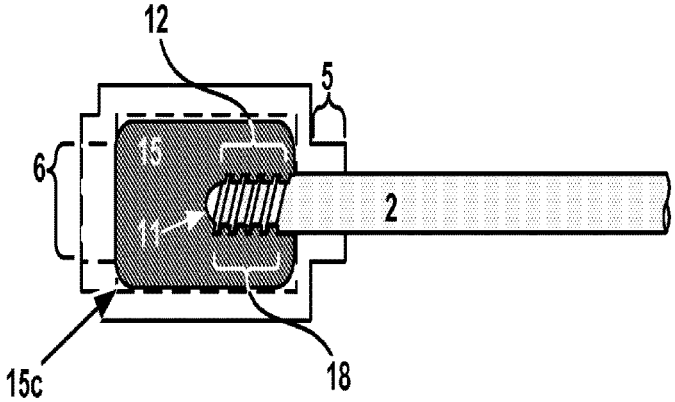

With reference to the illustrative embodiments of FIGS. 6A-B, an exemplary brick 10 may contain an exemplary socket 15 comprising a channel 16 having spiral threads 18 for complementary screw-threads 12 corresponding to head 1, tail 0, and/or terminus 11 of an exemplary screw linkage 2. As illustrated in these illustrative embodiments and may be used in others, an exemplary socket 15 may possess rounded surfaces 15*c* to reduce material usage and cost of fabrication. Alternatively, rounded surface 15*c* may take the form of a funnel-like structure adjacent an opening 5 or exit 6 to facilitate reception of an exemplary linkage 2 within the channel 16. An exemplary socket 15 may also be porous or sponge-like in material composition. While terminus 11 of exemplary screw linkage 2 may be pointed or conical, terminus 11 of an exemplary screw linkage 2 may be substantially flat, e.g., like the terminus 11 of linkage 2 in FIG. 7B.

As illustrated in FIG. 6B, screw threads 12 on the head 1 or tail 0 of an exemplary linkage 2 may be similar to a screw or other threaded fastener known to those skilled in the art. Likewise, threads 18 may be complementary to such screw threads 12 to allow for a robust connection between screw linkage 2 and exemplary screw socket 15. Alternatively, an exemplary screw linkage 2 with threads 12 may be used with sockets 15 without threads 18 and rely on the modulus of resilience of an exemplary socket 15 to brace such screw linkage 2 threads. One advantage of using an exemplary screw socket 15 in the aforementioned embodiments may be to establish a greater amount of surface contacts between screw linkage 2 and its thread surfaces 12 and an exemplary socket 15. Combining the various retention features described, e.g., grips 17 and/or screw channel 16, in one exemplary socket 15 may provide additional linkage 2 retention properties and advantages. For example, for an exemplary linkage 2 with a screw head 1 with threads 12 and a recess 3 distal of the threads 12, one may provide an exemplary socket 15 having a grip 17 proximal to the entry of the channel 16 and screw threads 18 distal from the entry so that the exemplary screw linkage 2 may both screw into an exemplary socket 15 and be restrained from movement by grip 17.

As illustrated in FIG. 7A, an exemplary brick 10 may be solid except for opening 5 in which a channel 16 with threaded wall 18 may be found and an exit 6 for receipt of an adjoining exemplary brick 10. Exemplary screw linkage 2 may then screw into exemplary brick 10 as shown in FIG. 7B. According to the illustrative embodiment of FIG. 7B, an exemplary screw linkage 2 may be received within screw channel 16 and screwed into threaded wall 18 using its threads 12 extending from the head 1 and/or tail 0 of screw linkage 2. The shape and/or dimensions of screw channel 16 may be based on the needs and loads of screw linkage 2. Alternatively, the shape and/or dimensions of screw channel 16 may be contingent on the shape and/or dimensions of exemplary brick 10. For example, screw channel 16 may be located adjacent to threads 18 found on opening 5 and/or exit 6. In an exemplary embodiment, exemplary brick 10 with screw channel 16 may be capable of assembly to other bricks (not shown) using the geometries of opening 5 and exit 6 even though it may have a screw channel 16 embedded therein or threads 18 on the inside of opening 5 and/or exit 6. This is the same for the other embodiments having a screw channel 16 in a socket 15.

Screw channel 16 may be made by boring out an exemplary brick 10 and using a tap and die to create the threads 18 of the channel for an exemplary screw linkage 2. Alternatively, a lathe may be utilized. Further alternatively, as disclosed herein, exemplary brick 10 containing a screw channel may be made using 3D printing technologies known to those skilled in the art.

In another exemplary embodiment illustrated by FIG. 7B, exemplary screw linkage 2 may be received within the material of exemplary brick 10. According to such embodiments, exemplary brick 10 may have an opening 5, exit 6, a cavity 9, and a screw channel 16 disposed between opening 5 and cavity 9 or between exit 6 and cavity 9. The screw channel 16 may be the only channel with threads 18 for interaction with threads 12 of terminus 11 of screw linkage 2. Alternatively, threads 18 may be found within opening 5 or exit 6 of an exemplary brick 10 and optionally may require an additional screw channel 16. The extension of threads beyond screw channel 16 to opening 5 and/or exit 6 may be provided for in any of the other disclosed embodiments involving screw linkages 2. According to the alternative embodiment where only opening 5 and/or exit 6 possess threads 18 may reduce the amount of threading required in exemplary brick 10 and/or an exemplary socket 15.

Other exemplary screw bricks 10 may be illustrated by way of FIGS. 7C-E. For example, an illustrative embodiment of an exemplary screw brick 10 as shown in FIG. 7C may not have an opening 5 but may have a screw channel 16, an exit 6, and a space 9 for assembly to other bricks (not shown). Alternatively, an exemplary screw brick 10 may only have a screw channel 16 and no other structures. In the illustrative embodiment of FIG. 7D, an exemplary screw brick 10 may have a plurality of screw channels 16 of various sizes, threading, and orientations. As illustrated, exemplary screw brick 10 of FIG. 7D may comprise one type of screw channel 16*p* and 16*q*, and another type of screw channel 16*r* in various sides of exemplary brick 10. According to this illustrative embodiment, an exemplary multi-screw port brick 10 may permit numerous flexible linkages 2 to extend therefrom. While exemplary brick 10 may be illustrated as rectilinear, there is no requirement that exemplary brick 10 need be so. When an exemplary brick 10 may comprise one or more screw channel 16*s* about a spherical surface, such an exemplary brick 10 may allow for multiple screw linkages 2 disposed in various planes in three-dimensional space at one time, e.g., FIG. 7E.

While screw channels 16*p*/16*q*/16*r* are oriented at 90 degrees, such screw channels do not need to be orthogonal to one another but may have more acute and/or obtuse angles with respect to one another. An exemplar of an exemplary brick 10 having an angled screw channel 16 may be understood with respect to FIG. 7E. An exemplary brick 10 may have one or more angled screw channels 16*s*/16*t* within its surfaces, including in corners or on other points of the exemplary brick 10 surface.

In another exemplary embodiment illustrated by FIG. 7E, an exemplary brick 10 may have a hybrid of rectilinear, rounded or spherical or hemispherical surfaces into which screw channel 16*s* may be disposed. In such embodiments, an exemplary screw linkage 2 may be oriented in a plane other than one orthogonal to the surface on which exemplary brick 10 may sit, e.g., where exemplary brick 10 assembles to other bricks (not shown), screw channel 16 may be oriented at less than 90 degrees from the exemplary brick-to-brick assembly surface. Similarly, in other exemplary embodiments, a plurality of screw channels 16 may be disposed on an exemplary brick 10 so that they are both oriented with respect to one another and exemplary brick 10 at non-orthogonal positions and/or less than 90 degrees from any exemplary brick-to-brick assembly surface.

Figure 7F:
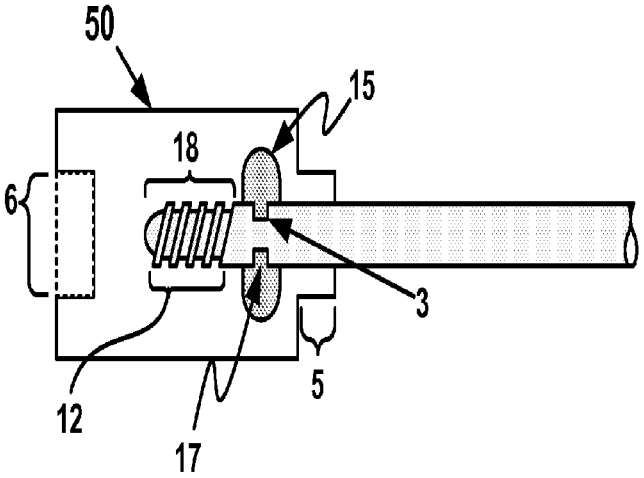

As described, an illustrative exemplary hybrid block 50 may be composed using 3D printing or other formation methods known to those skilled in the art. As illustrated in FIG. 7F, an exemplary hybrid building block 50 may comprise an exemplary socket 15 located in a cavity 9 between a screw channel 18 and opening 5. As illustrated, cavity 9 may hold an exemplary socket 15 having surface contours, such as grips 17, for gripping recesses 3 of an exemplary linkage 2. Accordingly, such an exemplary hybrid block 50 may allow an exemplary screw linkage 2 having threads 12 and recesses 3 about its length to have a plurality of coupling regions within exemplary block 50. In the illustrative embodiment of FIG. 7F, an exemplary linkage 2 may screw into exemplary block 50 while also being gripped by grips 17 of an exemplary socket 15. As illustrated, an exemplary socket 15 may act as a diaphragm or friction washer for an exemplary building block system joint 20. Any variety and order of linkage recesses 3, threads 12, and surfaces 3*a-g*, as described elsewhere, may be used up and down an exemplary linkage 2. As such, exemplary hybrid block 50 may have numerous sockets 15 and receiving cavities 9, with and without contours, e.g., threads 18, and in any order to accommodate a particular exemplary linkage 2 and/or add to retention of such linkage 2.

With reference to the illustrative embodiments of FIGS. 8, 8A-B, 9A-B, 10A-C, and 11A-C, an exemplary clamshell-type brick 30 (hereinafter referred to as "brick 30") may comprise a plurality of exemplary brick portions, for example, 10*a* and 10*b*, with inner surfaces 8*a* and 8*b*, respectively, coupled via flexible portion 31. Flexible portion 31 may be a piece of material of the same or different composition of other parts of exemplary brick 30. In one exemplary embodiment, exemplary brick 30 may be made from a polymer, such as an acrylic, while flexible portion 31 may be comprised of a more malleable polymer. In a preferred embodiment, flexible portion 31 may be capable of allowing exemplary brick 30 to open and close so that portions 10*a* and 10*b* abut one another so that surfaces 8*a* and 8*b* and outer surface 7 are substantially continuous. According to other illustrative embodiments, flexible portion 31 may be configured to allow exemplary brick 30 to open and close like a clam shell so that, when closed, substantially no gaps exist in one or more of outer surface 7, inner surfaces 8*a* and 8*b*, opening 5, or exit 6. While the illustrative embodiment of FIGS. 8, 8A-8B illustrate one flexible portion 31 in the longitudinal direction, numerous other flexible portions 31 may be found longitudinally about exemplary brick 30 to allow opening and closing of the same.

As further illustrated by the illustrative embodiment of FIG. 8, an exemplary brick 30 may be opened about flexible portion 31 such that two inner surfaces 8*a* and 8*b* for two halves 10*a* and 10*b*, respectively, are visible when viewing exemplary brick 30. Teeth 32*a* and 32*b* extend outwardly from the inner surfaces 8*a* and 8*b*, respectively. While teeth 32*a*/32*b* have been shown with rectangular cross-sections, any shape may be suitable for use for the construction of teeth 32*a*/32*b*. A view of an exemplary cross-section made by line A-A in FIG. 8 may be illustrated in FIG. 8A. As shown, the opening 5 of exemplary brick 30 may be opened about flexible portion 31 exposing teeth 32*a*/32*b* and the upper surfaces 7 of halves 10*a* and 10*b*.

A view of an exemplary cross-section made by line B-B in FIG. 8 may be illustrated by FIG. 8B. As illustrated, an exemplary brick 30 may be opened so that teeth 32*a*/32*b* are exposed for the exemplary brick 30 halves, 10*a* and 10*b*, respectively. Again, these halves 10*a*/10*b* open about flexible portion 31. FIG. 9A illustrates an exemplary operation of an exemplary brick 30. In the illustrative embodiment of FIG. 9A, an exemplary linkage 2 with recesses 3 and fins 3*a* at head 1 may be configured to receive a complimentarily shaped tooth 32*a*/32*b*. Accordingly, the toothed exemplary clam brick 30 illustrated in these embodiments may be used to lock in place an exemplary linkage 2 having a properly configured head 1 based on the surface structure of an exemplary linkage 2 and the inner surface 8*a*/8*b* structures of exemplary clam brick 30.

In another exemplary embodiment, exemplary brick 30 may be able to retain an exemplary linkage 2 with or without additional supports. In the former scenario, a hollow exemplary cap brick 40 may be used in which a hole sized to fit an exemplary linkage 2 slides down linkage 2 to the juncture between linkage 2 head 1 and exemplary clam brick 30. An exemplary cap brick 40 may have a peg portion 41, a ridge portion 43, a through-hole 44, and a receiver portion 42 for reception with other exemplary bricks 10/30/40/50/60/70/100. According to the illustrative embodiment of FIG. 9A, an exemplary cap brick 40 receiver portion 42 may receive within itself the opening 5 of exemplary clam brick 30. Accordingly, exemplary cap brick 40 may preclude exemplary clam brick 30 from opening by virtue of its holding the opening 5 of exemplary clam brick 30 together, as may be understood with respect to FIG. 9B. Further exemplary bricks (not shown), may be attached to the peg portion 41 as needed. Exemplary cap brick 40 may take various other forms and sizes as needed and may be a portion of a building block that does not have a hollow passage for an exemplary linkage 2 there through, e.g., a 2×2 Lego® plate brick may have one stud that is an exemplary cap brick 40 and the remaining three studs or pegs as provided in the prior art.

Figure 10A:
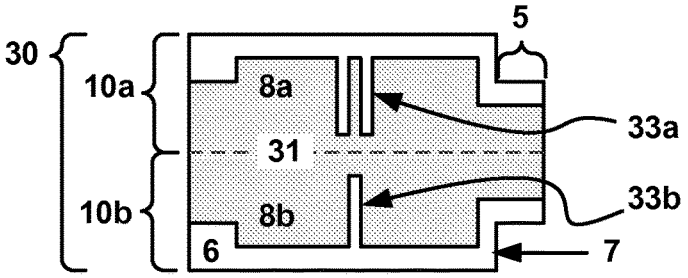
FIGS. 10A-C, 11A-C, 12A-C, and 13A-C illustrate other exemplary embodiments of anchor blocks and linkages used in forms of an exemplary inventive building block systems and assembly methods.
Figure 10B:
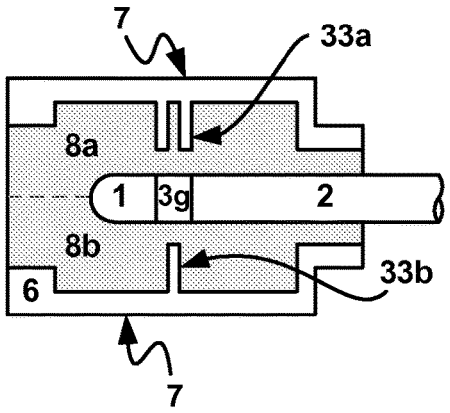
Figure 10C:
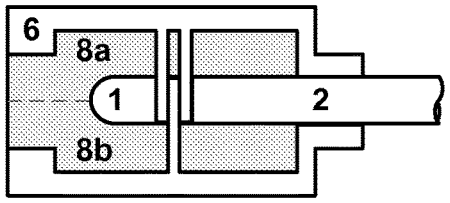

In another exemplary embodiment of exemplary clam brick 30, as may be seen with reference to FIG. 10A, halves 10*a* and 10*b* may have on their inner surfaces 8*a* and 8*b*, respectively, a male receptor 33*a* and a female receptor 33*b*, each configured to couple to the other in a nested or overlapping arrangement. In use, an exemplary linkage 2 with a head hole 3*g* in head 1 may be configured for reception within exemplary brick 30 and aligned with receptors 33*a/b* so that when exemplary clam brick 30 closes, the receptors 33*a/b* intersect within and/or through head hole 3*g* of head 1 of an exemplary linkage 2. Accordingly, as illustrated in FIGS. 10B and 10C an exemplary linkage may be threaded by the receptors 33*a/b* when exemplary clam brick 30 is closed. As may be further illustrated in FIG. 11A, any number or arrangement of receptors 33*a/b* may be utilized for the particular purpose. As previously stated, receptors 33*a/b* may be any shape or configuration suitable for use as holding an exemplary linkage 2 received in the exemplary brick 30.

Figure 11A:
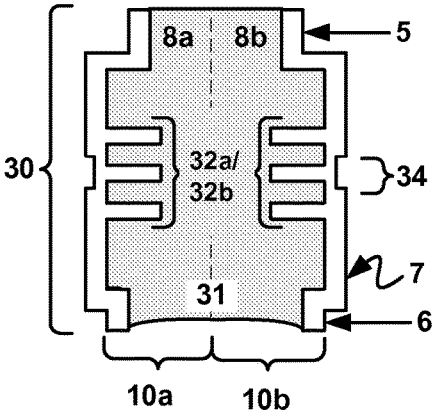
Figure 11B:
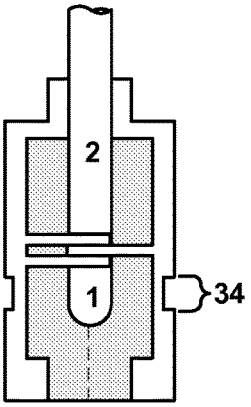
Figure 11C:
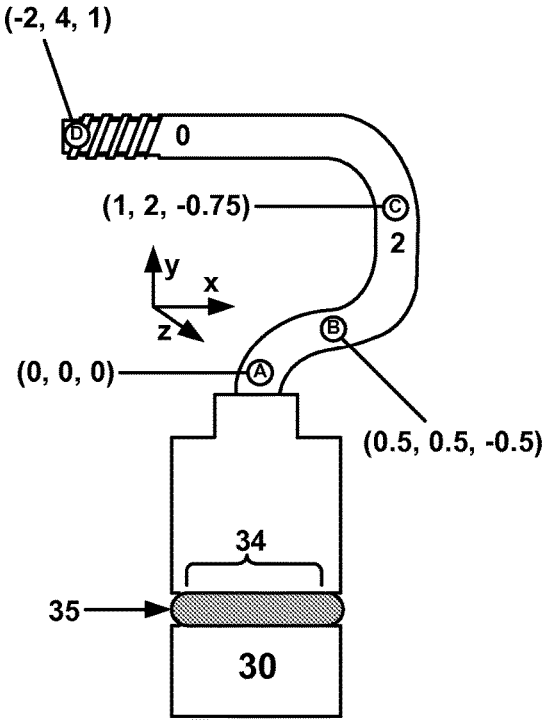

With respect to the illustrative embodiments of FIGS. 11A-C, an exemplary clam brick 30 may contain a groove 34 in outer surface 7 of its halves 10*a/b* for receiving a brace 35 therein. As illustrated, an exemplary groove 34 may be of any type of cross-section for the purpose and brace 35 may be made out of any type of material capable of holding an exemplary brick 30 together. In a preferred embodiment, groove 34 may be a rectangular cross-section configured so that when brace 35 is placed therein, the brace 35 and outer surface 7 of exemplary brick 30 are substantially aligned.

As illustrated in FIG. 11C, a brace 35, which may preferably be made of an elastomer, such as rubber, is shown as being wrapped tightly about exemplary brick 30 while an exemplary linkage 2 is free to move outside of exemplary brick 30. As another exemplary embodiment of the posability and universal orientation of an exemplary linkage 2 may be further illustrated in FIG. 11C.

As illustrated in FIG. 11C, an exemplary linkage 2 may exit an exemplary brick 30 at point "A." An exemplary linkage 2 may be undulated at point "B" so that it enters point (0.5, 0.5, −0.5), which means that as this part of linkage 2 ascends and proceeds to the right, it also goes behind point "A." Point "C," at coordinates (1, 2, −0.75), illustrates that an exemplary linkage 2 may be further bent behind point "B" while gravitating upwardly and further ahead of point "A" in the horizontal plane. Further illustrating the universal positioning of an exemplary linkage 2, point "D" located at the terminus 11 of tail 0 (which is shown with spiraling threads 12 thereon) may have coordinates (−2, 4, 1) thereby showing that the tail 0 of an exemplary linkage 2 may be bent behind its origin point and brought forward of the origin, even though it began with bending behind the origin (as in points "B" and "C"). As described, an exemplary linkage 2 would be configured to maintain bricks coupled to either of its ends in this configuration in three-dimensional space. Alternatively, an exemplary linkage 2, by virtue of its flexibility, may be configured to change these illustrated coordinates when displacing bricks coupled to its ends.

With reference to FIGS. 12A-C and FIGS. 13A-C, an exemplary porous brick 60 may be one possessing multiple cavities/apertures in its construction. For example, with respect to the exemplary porous brick 60 illustrated in FIG. 12A, such exemplary brick 60 may have one or more openings 5 extending from its outer surface 7, a first cavity 9 leading to one or more exits 6 and additional cavities 9*a*, and one or more inner surfaces 8 which may have one or more crevices 8*a*. In a preferred embodiment, exemplary porous brick 60 may be an Erling Lego-like brick.

Figure 12B:
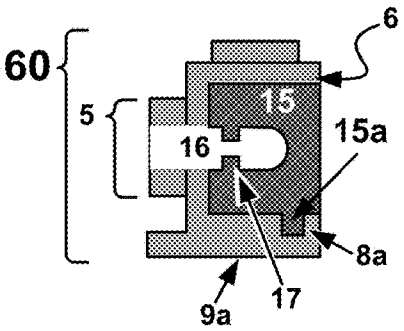
Figure 12A:
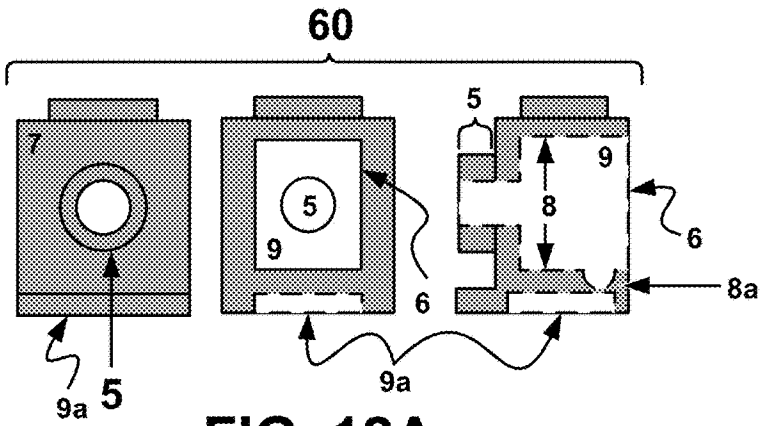

An exemplary porous brick 60 may be further illustrated in FIG. 12A with views from the front, rear, and side of the exemplary porous brick. Other types of exemplary porous bricks 60 may be readily understood by persons skilled in the art and may be used in addition to the illustrative exemplary porous brick 60 described. One or more of the openings 5 of an exemplary porous brick 60 may be configured to receive an exemplary linkage 2 therein.

In another embodiment in accordance with the illustrative features of FIG. 12B, an exemplary porous brick 60 may receive within its inner surface 8 an exemplary socket 15 adapted to fit within one of its cavities 9 so as to close off exit 6. In another embodiment, an exemplary socket 15 may have one or more wings 15*a* configured to be received within a crevice 8*a* in one of the cavities 9 of exemplary porous brick 60. An exemplary fitting of an exemplary socket 15 within exemplary porous brick 60 may provide a channel 16 through opening 5 for reception of an exemplary linkage 2 therein. According to the illustrative embodiment of FIG. 12B, an exemplary channel 16 may be a contoured channel 16 which may contain one or more grips 17. According to an exemplary method of use of an exemplary porous brick 60 with an exemplary socket 15, the first exemplary step may be to align an exemplary socket 15 to be placed within a complementary inner surface 8 of an exemplary porous brick 60 cavity. The second exemplary step may be to align socket channel 16 with an opening in the exemplary porous brick 60. The third exemplary step may be to use an exemplary linkage 2 head 1 to engage the combination of exemplary porous brick 60 and an exemplary socket 15 through an opening 5. The fourth exemplary step may be to couple exemplary porous brick 60 to adjacent exemplary bricks to preclude the disposition of an exemplary socket 15 from within exemplary porous brick 60 while in use. According to an exemplary embodiment, the third and fourth exemplary steps may be had in either order depending on needs. Further, while a contoured channel 16 may be shown, any other channels 16 (e.g., screw channels) may be contemplated as well as contoured openings 5 and/or exits 6 of such exemplary bricks 60 as per other embodiments.

Figure 12C:
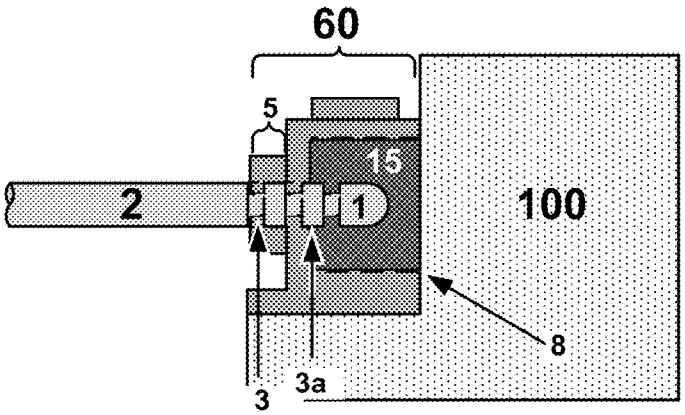

With reference to FIG. 12C, an exemplary porous brick 60 alone or in combination with an exemplary socket 15 may be connected to an exemplary brick assembly 100 in which its cavity 9 where an exemplary linkage 2 may be received is closed off by surrounding exemplary bricks in the exemplary brick assembly 100. Exemplary brick assembly 100 may be comprised of one or more bricks compatible with exemplary porous brick 60 and receptive to its attachment and/or connection. As shown in the illustrative embodiment of FIG. 12C, an exemplary linkage 2 may be received through opening 5 of exemplary porous brick 60, which houses an exemplary socket 15 within its cavity 9, and is juxtaposed by exemplary brick assembly 100 such that an exemplary socket 15 is substantially confined within exemplary porous brick 60. According to this exemplary embodiment, an exemplary linkage 2 may have a contoured head 1. In an exemplary embodiment, which happens to be illustrated in FIG. 12C, recesses 3 and fins 3*a* of head 1 interact with grips 17 of contoured channel 16 of an exemplary socket 15 to substantially retain an exemplary linkage 2 within exemplary porous brick 60.

Figure 13A:
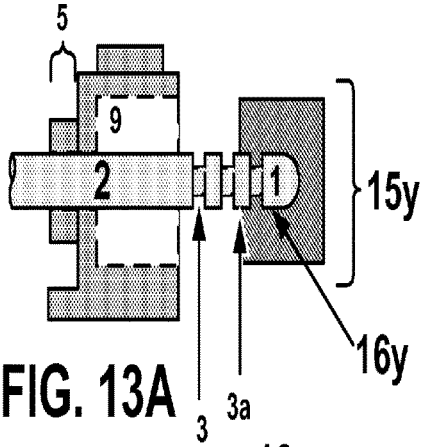

In one aspect of the illustrative embodiments of FIGS. 12A-C, an exemplary porous brick 60 may have the added benefit of ease of removal of an exemplary linkage 2 from an exemplary socket 15. One exemplary illustration of such benefits may be shown with respect to FIGS. 13A-C. As shown in the exemplary illustrative embodiment of FIG. 13A, an exemplary linkage 2 may be used to expel an exemplary socket 15 out of a cavity 9 in exemplary porous brick 60. In one view, the cross-section of an exemplary socket 15, shown as socket 15*y*, shows engagement of head 1 of an exemplary linkage 2 by one or more surface contours, such as fins 3*a* and recesses 3, although others are contemplated and may be understood to those skilled in the art. As shown in FIG. 13A, the cross-sectional view of an exemplary linkage 2 socket channel 16*y* illustrates an exemplary engagement with head 1 of an exemplary linkage 2, as disclosed.

Figure 13B:
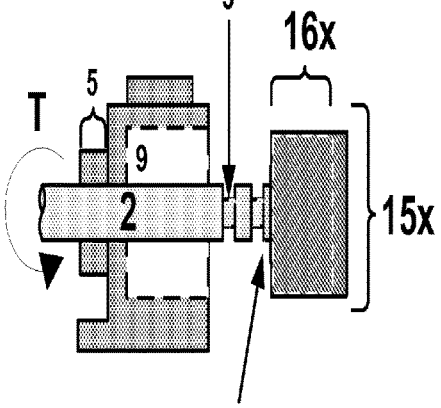
Figure 13C:
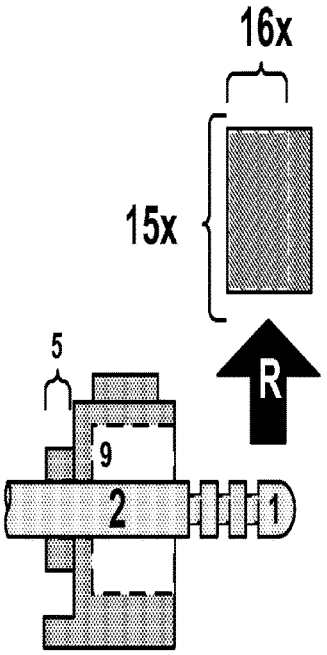

FIG. 13B illustrates a view of the exemplary porous brick 60, an exemplary socket 15, and exemplary linkage 2 arrangements in another aspect of operation. According to the illustrative embodiment of FIG. 13B, while still engaged within an exemplary socket 15 and exemplary porous brick 60 but with an exemplary socket 15 expelled from exemplary porous brick 60, an exemplary linkage 2 may be rotated, e.g., within any 360 degree movement, but more preferably 180 degrees, within opening 5 such that the exemplary socket 15 may be turned (as shown by the arrow adjacent the letter "T") in a different orientation, so that a side passage 16*x* faces perpendicular to exemplary porous brick 60. Side passage 16*x* may be a passage from either side of socket channel 16 by which socket 15 may be slidingly disengaged from head 1 of an exemplary linkage 2. In an exemplary embodiment, a portion 15*x* of an exemplary socket 15 may be removed (as shown by the arrow adjacent the letter "R") by slipping head 1 of an exemplary linkage 2 out of socket channel 16 by way of side passage 16*x*, as may be illustrated by FIG. 13C.

Any disclosed socket 15 may have one or more side passages 16*x* to allow an exemplary linkage 2 to disengage from an exemplary socket 15 in either exemplary porous bricks 60 or other exemplary bricks 10 as disclosed. Side passages 16*x* may be used to allow users to switch different sockets 15 depending on needs, or allow for further materials and/or exemplary bricks 10/30/40/50/60/70 to be placed on an exemplary linkage 2 while constructing. Alternatively, slide passages 16*x* embodiments of exemplary sockets 15 may be preferable for replacing sockets 15 after repeated use.

Figure 14A:
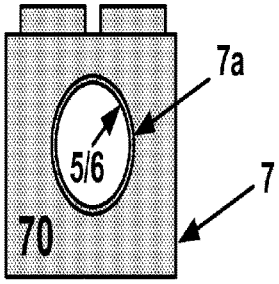
FIGS. 14A-D illustrate other exemplary embodiments of adaptors for exemplary blocks and linkages used in other forms of an exemplary inventive building block systems and assembly methods.

In the illustrative embodiments of FIGS. 14A, 14B, 14C and 14D, yet other mechanisms of linkage systems may be disclosed. For example, FIG. 14A shows an exemplary brick 70 with a passage 5/6 through its thickness for reception of parts much larger in diameter than exemplary linkage 2. Such exemplary bricks 70 may be found in Lego® Technic sets or other non-Lego® building block systems, e.g., K'nex. Exemplary bricks 70 may have surface contours 7*a* that surround or are adjacent to their passages 5/6. An exemplary contour 7*a* may be an indentation in the surface 7 of exemplary brick 70.

Figure 14B:
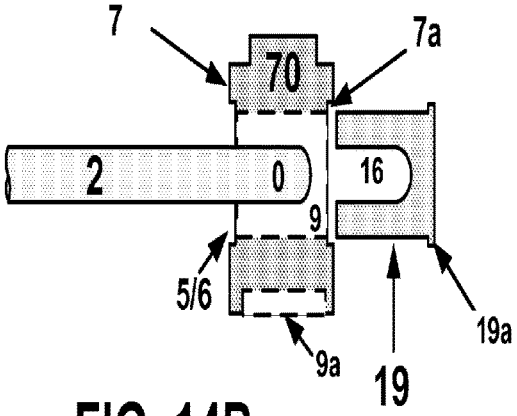

As illustrated in FIG. 14B, an exemplary linkage 2 with a tail 0 may be placed within the cavity 9 of the exemplary brick 70 connected by passage 5/6. An adaptor socket 19 may possess an exemplary channel 16 configured as other disclosed channels of sockets 15 for reception of an exemplary linkage 2 therein. An exemplary adaptor socket 19 may possess one or more anchors 19*a* substantially complementary to surface contours 7*a* of exemplary brick 70. Exemplary anchors 19*a* may take the form of lips, rims, or pegs, but may be any other structures that may serve to hold adaptor socket 19 within exemplary brick 70, either on surface contours 7*a* of exemplary brick 70 or crevices 8*a* in exemplary brick 70 (see FIG. 14C). Exemplary surface contours 7*a* and crevices 8*a* may be utilized within exemplary brick 70 to allow for friction fitting of adaptor socket 19 within the exemplary brick 70 cavity 9.

An exemplary adaptor socket 19 may be sized and shaped to fit within the cavity 9 of exemplary brick 70 so as to allow an exemplary linkage 2 to couple within exemplary brick 70 despite the fact that exemplary brick 70 may not normally hold an exemplary linkage 2 to keep it from moving or exiting the brick or block. This may be done by making adaptor socket 19 larger than the passage 5/6 of exemplary brick 70 to allow an exemplary adaptor socket 19 to friction fit within the cavity 9 of the exemplary brick 70. Alternatively, adaptor socket 19 may have surface contours 19*b*, which may be any size and cross-section as needs may be, that when combined with crevices 8*a* in exemplary brick 70 resist removal of the adaptor socket 19 while in use.

Figure 14C:
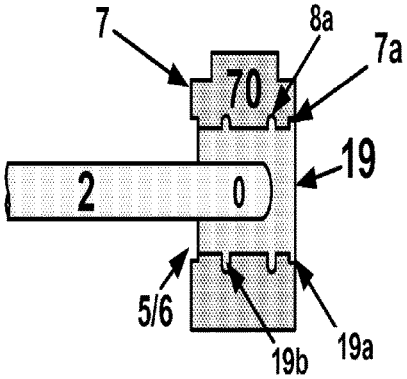
Figure 14D:
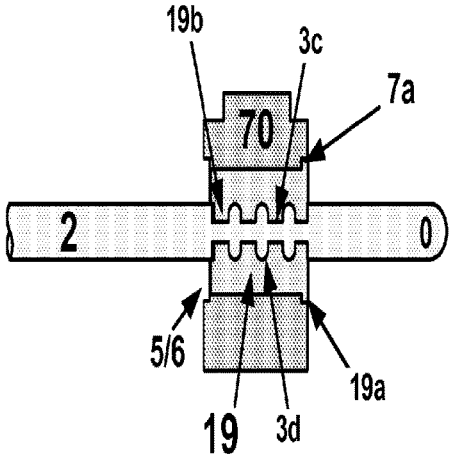

In an exemplary adapted brick 70 system illustrated by FIG. 14C, an exemplary linkage 2 may have its tail 0 within channel 16 of adaptor socket 19, much like an exemplary linkage 2 may fit within channel 16 of an exemplary socket 15. One or more crevices 8*a* within cavity 9 of exemplary brick 70 may receive one or more adaptor surface contours 19*b*. Adaptor socket 19 may have a solid portion that resists further displacement of an exemplary linkage 2 into channel 16. Alternatively, channel 16 of adaptor socket 19 may allow for complete passage of an exemplary linkage 2 there through, as illustrated by FIG. 14D. As illustrated in FIG. 14D, adaptor contours 19*b* may be used to brace the surface contours 3 and/or 3*a* of an exemplary linkage 2. Thus, an exemplary adaptor socket 19 and any of its various surface contours 19*b* and anchors 19*a* may function and be formed in the same manner as an exemplary socket 15 and its compression surfaces/wings 15*a*, e.g., elastomer material and/or flexible material. Alternatively, an exemplary adaptor socket 19 may be made of a more rigid material that may be screwed or snapped into exemplary brick 70 by way of spiral contours 19*b* coinciding with screw thread crevices 8*a* within cavity 9 of exemplary brick 70. Other snap-to-fit arrangements of an exemplary adaptor socket 19 and exemplary brick 70 may be used as well to reduce tooling for an exemplary brick 70. An exemplary adaptor socket 19 may also be removed from an exemplary linkage 2 in similar manner to removal of an exemplary socket 15 as disclosed.

Figure 15:
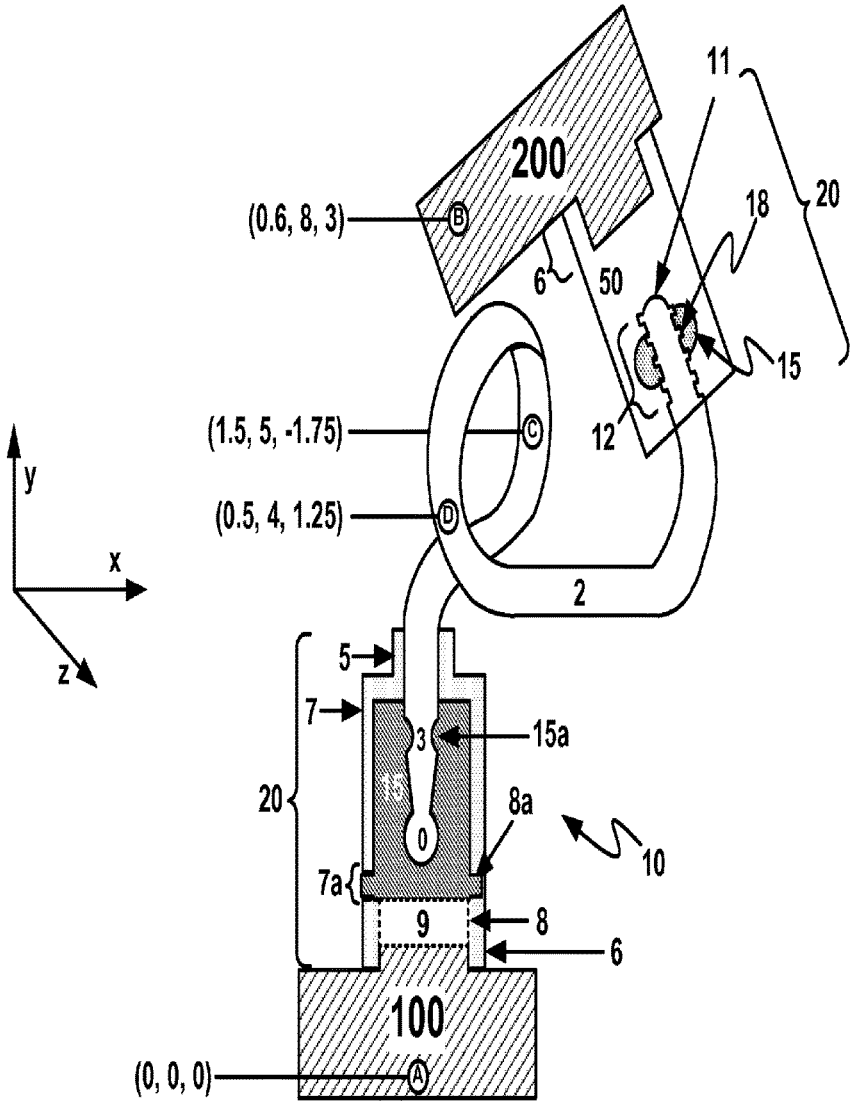
FIG. 15 illustrates an exemplary embodiment of an exemplary inventive building block system.

An example of an exemplary linkage 2 posability may be illustrated in FIG. 15. According to this illustrative embodiment, FIG. 15 may show the positioning of exemplary blocks 10 and 50 in three-dimensional space. As shown by the coordinates of points "A" and "B" of exemplary blocks 10 and 50, respectively, an exemplary linkage 2 may position the exemplary blocks and their adjoining assemblies 100 and 200, respectively, in different positions in three-dimensional space. These exemplary blocks may be further moved with respect to one another by virtue of the flexibility of an exemplary linkage 2. Exemplary linkage 2 may be disposed in various parts of three-dimensional space, as may be illustrated by FIG. 15, with reference to the coordinates of points "C" and "D" on sections of an exemplary linkage 2. According to this illustrative embodiment, the posability of an exemplary linkage 2 may substantially maintain the parts of an exemplary linkage 2 in their illustrated conformation, e.g., coordinates "C" and "D." Further, the posability of an exemplary linkage 2 may substantially maintain exemplary blocks 10 and 50 (or other exemplary blocks 30/40/60/70) and their respective adjoining assemblies 100 and 200, respectively, at their coordinates "A" and "B," respectively, over a span of time.

Those skilled in the art may understand various other methods and ways to secure an exemplary linkage 2 to an exemplary brick 10/30/40/50/60/70 using other techniques. Exemplary bricks 10/30/40/50/60/70 that may open or "lock" an exemplary head 1 of an exemplary linkage 2 may take various forms and variations, depending on the needs of the construction. They may involve exemplary bricks 10/30/40/50/60/70 with doors, clasps, or other moveable parts that allow an exemplary head 1 of an exemplary linkage 2 to enter and then resist exiting the exemplary brick 10/30/40/50/60/70.

For all exemplary embodiments, whether illustrated, described, or understood from combination from the disclosures herein, exemplary bricks 10/30/40/50/60/70, brace 35, and/or sockets 15/19 may be printed using 3D printers known to those skilled in the art, such as those made or used by MakerBot Industries LLC of Brooklyn, N.Y. (Replicator series), Mcor Technologies Ltd. of Co Louth, Ireland (Iris series and Matrix series), 3D Systems Corp. of South Hill, S.C. (ProJet series and CubePro series), Voxeljet AG of Friedberg, Germany (VX series and VXC series), The ExOne Company of North Huntington, Pa. (S-Max, S-Print, M-Print, M-Flex, X1-Lab, and Orion series), Arc Group Worldwide of DeLand, Fla., and Stratasys, Inc. of Eden Prairie, Minn. (Mojo, uPrint SE series, Objet series, Dimension, Fortus, and printers using FDM, WDM, and Polyjet technologies). Exemplary blocks or bricks 10/30/40/50/60/70, brace 35, and/or socket/adapter 15/19 may also be manufactured using extrusion, blow molding, casting, or other fabrication methods known to those skilled in the building block art. While an exemplary linkage 2 may also be 3D printed, it may also be machined from metal or equivalent materials, as described herein, using laser cutting and sintering, extrusion, stamping, or CNC machining.

In an exemplary embodiment, an exemplary socket 15 may be 3D printed within exemplary brick 10 while exemplary brick 10 is being formed. Alternatively, exemplary brick 10 may be 3D printed and socket 15 may be simultaneously 3D printed within exemplary brick 10 (e.g., an exemplary hybrid brick 50). 3D printing fabrication of an exemplary brick 10 and socket 15 subsystem may be particularly suited for mass production of such constructs and reduce the need for physical assembly of the two structures post-fabrication.

In an exemplary embodiment, an Objet260 and Objet500 Connex Multimaterial 3D printer manufactured by Stratasys, Inc. of Eden Prairie, Minn. or a ProJet 5500X manufactured by 3D Systems Corp. of South Hill, S.C. may form exemplary brick 10/30/40/50/60/70 using one material while also using another material for the socket 15, thereby reducing the assembly process and increasing the likelihood of precise fitting between the socket 15 and exemplary brick 10. Any and all embodiments described herein may be formed by such simultaneous 3D printing processes known to those skilled in the building block art (e.g., exemplary hybrid blocks 50).

Many further variations and modifications may suggest themselves to those skilled in art upon making reference to above disclosure and foregoing interrelated and interchangeable illustrative embodiments, which are given by way of example only, and are not intended to limit the scope and spirit of the interrelated embodiments of the invention described herein. While many of the exemplary bricks 10/30/40/50/60/70 have been disclosed, these exemplary bricks may be integrated components with other exemplary building blocks and need not exist in isolation. Thus, it is contemplated that the exemplary bricks 10/30/40/50/60/70 and their various surface structures and dimensions may be utilized in conjunction with and as integrated parts of presently available building block systems in addition to functioning on their own.

The invention claimed is:

1. A toy linkage having a cross-section that is orthogonal to its longitudinal axis, the toy linkage comprising:

a first end and a second end, wherein each of the first end and the second end is configured to translate within an opening in a snap-fit interlocking toy building block;

a posable wire interconnecting the first end to the second end; and an opening on the toy linkage, wherein the opening is located between the first end and the second end and is perpendicular to the longitudinal axis.

2. The toy linkage of claim 1, wherein the cross-section comprises a diameter that is no less than approximately 0.125 inches and no greater than approximately 0.193 inches.

3. The toy linkage of claim 2, wherein the cross-section comprises a diameter that is approximately 0.125 inches.

4. The toy linkage of claim 2, further comprising at least one additional opening in the toy linkage.

5. The toy linkage of claim 4, wherein the at least one additional opening in the toy linkage is perpendicular to the longitudinal axis.

6. The toy linkage of claim 2 further comprising a contour selected from the group consisting of (a) round, conical, or spherical surfaces, (b) bumps, (c) recesses, (d) discs, (e) fins, and (f) screw-like threads on the first end, the second end, or combinations thereof.

7. The toy linkage of claim 1, wherein the toy linkage cross-section is approximately the same as a cross-section of either: (i) a cylindrical stud extending perpendicularly from a first surface of the snap-fit interlocking toy building block, or (ii) the opening in the snap-fit interlocking toy building block, wherein the cylindrical stud is dimensioned to snap-fit in a cavity of the snap-fit interlocking toy building block.

8. The toy linkage of claim 7, further comprising at least one additional opening in the toy linkage.

9. The toy linkage of claim 8 further comprising a contour selected from the group consisting of (a) round, conical, or spherical surfaces, (b) bumps, (c) recesses, (d) discs, (e) fins, and (f) screw-like threads on the first end, the second end, or combinations thereof.

10. The toy linkage of claim 8, wherein the at least one additional opening in the toy linkage is perpendicular to the longitudinal axis.

11. The toy linkage of claim 10, further comprising a coating about the posable wire and along the toy linkage longitudinal axis, wherein between the first end and the second end, no less than approximately 30% and no more than approximately 50% of the toy linkage cross section is comprised of the posable wire, and further wherein the toy linkage cross-section comprises a diameter that is no less than approximately 0.125 inches and no greater than approximately 0.193 inches.

12. A kit comprising the toy linkage of claim 11, which further comprises the snap-fit interlocking toy building block.

13. The toy linkage of claim 10, further comprising a contour selected from the group consisting of (a) round, conical, or spherical surfaces, (b) bumps, (c) recesses, (d) discs, (e) fins, and (f) screw-like threads on the first end, the second end, or combinations thereof.

14. The toy linkage of claim 7, wherein the cylindrical stud is orthogonal to the opening.

15. The toy linkage of claim 1, further comprising at least one additional opening in the toy linkage.

16. The toy linkage of claim 15, wherein the at least one additional opening in the toy linkage is perpendicular to the longitudinal axis.

17. The toy linkage of claim 1 further comprising a contour selected from the group consisting of (a) round, conical, or spherical surfaces, (b) bumps, (c) recesses, (d) discs, (e) fins, and (f) screw-like threads on the first end, the second end, or combinations thereof.

18. The toy linkage of claim 1, further comprising a coating about the posable wire and along the toy linkage longitudinal axis.

19. The toy linkage of claim 18, wherein between the first end and the second end, no more than approximately 50% of the toy linkage cross section is comprised of the posable wire.

20. A toy linkage having a cross-section that is orthogonal to a longitudinal axis, the toy linkage comprising:

a plurality of ends each of which having an area substantially equal to one of at least two cylindrical openings in a snap-fit interlocking toy building block, wherein a largest one of the at least two cylindrical openings in the snap-fit interlocking toy building block is configured for receiving only one cylindrical stud of another snap-fit interlocking toy building block;

a posable wire arranged about the toy linkage longitudinal axis and interconnecting at least two of the plurality of ends; and a coating about the posable wire and along the toy linkage longitudinal axis, wherein between the at least two of the plurality of ends, no more than approximately 50% of the toy linkage cross section is comprised of the posable wire.

21. The toy linkage of claim 20, wherein the cross-section comprises a diameter that is no less than approximately 0.125 inches and no greater than approximately 0.193 inches.

22. The toy linkage of claim 21, further comprising a contour selected from the group consisting of (a) conical or spherical surfaces, (b) bumps, (c) recesses, (d) discs, (e) fins, and (f) screw-like threads on the first end, the second end, or combinations thereof.

23. A snap-fit interlocking toy building block connector having a posable metal wire and a cover, wherein the snap-fit interlocking toy building block connector consists essentially of between approximately 30% and approximately 50% posable metal wire, wherein the connector has a cross-section that is approximately the same as at least one cylindrical stud or at least one cylindrical opening belonging to a snap-fit interlocking toy building block, wherein the at least one cylindrical stud and the at least one cylindrical opening are orthogonal to one another on the snap-fit interlocking toy building block.

24. The snap-fit interlocking toy building block connector of claim 23, wherein the cross-section comprises a diameter that is no less than approximately 0.125 inches and no greater than approximately 0.193 inches.

25. The snap-fit interlocking toy building block connector of claim 24, wherein the cross-section comprises a diameter that is approximately 0.125 inches.

* * * * *